US008063857B2

(12) United States Patent
Kohno et al.

(10) Patent No.: US 8,063,857 B2
(45) Date of Patent: Nov. 22, 2011

(54) IMAGE DISPLAY APPARATUS

(75) Inventors: Tohru Kohno, Kokubunji (JP); Mitsuhide Miyamoto, Kokubunji (JP); Hajime Akimoto, Kokubunji (JP)

(73) Assignee: Hitachi Displays, Ltd., Chiba-ken (JP)

( * ) Notice: Subject to any disclaimer, the term of this patent is extended or adjusted under 35 U.S.C. 154(b) by 1004 days.

(21) Appl. No.: 12/003,373

(22) Filed: Dec. 21, 2007

(65) Prior Publication Data

US 2008/0218452 A1 Sep. 11, 2008

(30) Foreign Application Priority Data

Mar. 9, 2007 (JP) ..... 2007-060395

(51) Int. Cl.
*G09G 3/30* (2006.01)

(52) U.S. Cl. ..... 345/76; 345/77; 345/78; 345/82; 345/690; 345/691; 345/204; 315/169.3

(58) Field of Classification Search ..... 345/76–83, 345/204–211, 690, 691; 315/169.3; 313/483, 313/486, 500, 505–507; 327/108–112; 326/82–83
See application file for complete search history.

(56) References Cited

U.S. PATENT DOCUMENTS

| | | | | |
|---|---|---|---|---|
| 2003/0067424 | A1* | 4/2003 | Akimoto et al. | 345/55 |
| 2005/0110420 | A1* | 5/2005 | Arnold et al. | 315/169.3 |
| 2006/0082528 | A1* | 4/2006 | Guo et al. | 345/82 |
| 2006/0232521 | A1* | 10/2006 | Jang et al. | 345/76 |
| 2007/0139315 | A1* | 6/2007 | Abe | 345/76 |
| 2007/0164940 | A1* | 7/2007 | Guo et al. | 345/76 |
| 2007/0296651 | A1* | 12/2007 | Kim et al. | 345/76 |
| 2008/0007499 | A1* | 1/2008 | Kawabe | 345/82 |
| 2008/0048951 | A1* | 2/2008 | Naugler et al. | 345/82 |
| 2008/0252573 | A1* | 10/2008 | Fish et al. | 345/80 |
| 2009/0027374 | A1* | 1/2009 | Kohno et al. | 345/212 |

FOREIGN PATENT DOCUMENTS

| | | |
|---|---|---|
| JP | 2003-005709 | 6/2001 |
| JP | 2003-122301 | 10/2001 |
| WO | WO-2005/116970 A1 * | 12/2005 |

OTHER PUBLICATIONS

R.M.A. Dawson et al., "Design of an Improved Pixel for a Polysilicon active-Matrix Organic LED Display", SID 98 Digest, pp. 11-14.

* cited by examiner

*Primary Examiner* — Lun-Yi Lao
*Assistant Examiner* — Priyank Shah
(74) *Attorney, Agent, or Firm* — Stites & Harbison PLLC; Juan Carlos A. Marquez, Esq.

(57) ABSTRACT

When an organic EL display apparatus enables display of a standard luminance mode and a high luminance mode, it takes long time to reset the gate potential of the OLED drive TFT to a given value in a standard mode. In the reset operation of the gate potential of an OLED drive TFT at the time of writing an image signal, in a standard mode, a precharge current is allowed to flow in the OLED element for a short period before the reset operation to set an initial value of the gate potential of the OLED drive TFT to be close to a supply potential or a reference potential. With the above operation, the variation of the OLED drive TFT gate potential after resetting is reduced. As a result, the light emitting period during one frame can be extended. Also, since a blanking period can be extended, it is possible to measure the characteristic of the OLED element by using the blanking period.

17 Claims, 19 Drawing Sheets

IMAGE DISPLAY APPARATUS

CLAIM OF PRIORITY

The present application claims priority from Japanese application JP 2007-060395 filed on Mar. 9, 2007, the contents of which is hereby incorporated by reference into this application.

FIELD OF THE INVENTION

The present invention relates to an organic EL display apparatus, and more particularly to a display apparatus that is capable of changing over a mode according to a display luminance at the time of a maximum gradation.

BACKGROUND OF THE INVENTION

Up to now, the main display apparatus has been CRT. Instead of the CRT, a liquid crystal display apparatus or a plasma display apparatus which are flat display apparatuses are put into practical use, and increasingly demanded. Also, in addition to those display apparatuses, a display apparatus (hereinafter referred to as "organic EL display apparatus (OLED)") using organic electro luminescence and a display apparatus (FED display apparatus) in which electron sources using field emission are arranged in a matrix, and illuminate phosphors that are arranged on anodes to form an image are increasingly developed and put in practical use.

The organic EL display apparatus has the following features. (1) No backlight is required because the organic EL display apparatus is of the light emitting type as compared with liquid crystal. (2) There is the possibility that the power consumption can be reduced because a voltage required for light emission is 10 V or lower. (3) The organic EL display apparatus is suitable for lightweight and thinning because no vacuum structure is required as compared with the plasma display apparatus and the FED display apparatus. (4) The organic EL display apparatus is excellent in the moving picture characteristic because a response time is several microseconds which is short. (5) A viewing angle is 170 degrees or more which is wide.

Because the organic EL display apparatus can be lightened in weight and thinned, the device can be widely used also as a portable display apparatus. In order to keep the viewability of a screen even outdoors where outside light is strong, it is necessary to display the screen with high luminance. On the other hand, a normal display mode can be applied in use indoors. From the viewpoint of the power consumption, it is desirable that the display mode can be changed over.

FIG. 11 shows a relationship between the voltage and the luminance of an OLED element 1. The emission luminance of the OLED element 1 increases more as an applied voltage is higher. When a supply voltage increases, a current that flows in the OLED element 1 increases, and the recombination of electrons with holes is increased to enhance the emission intensity. Accordingly, a display apparatus having plural maximum luminance, that is, a display apparatus that can change over the display mode is generally realized by changing the supply voltage.

On the other hand, the organic EL display device using a thin film transistor (TFT) is excellent in image quality such as contrast. However, when gradation display is conducted, the display characteristic is varied with being affected by the characteristic variation of the respective TFTs. As an example of the conventional art that copes with the above drawback, there is a technique shown in FIGS. 12 to 14, which is called "first conventional example" in the present specification.

FIG. 12 shows a driver circuit for a pixel portion in the first conventional example. In FIG. 12, an OLED element 1, a lighting TFT switch 2, and an OLED driving TFT 3 are connected in series between a power supply line 51 and a reference potential. In this example, the reference potential is a potential that is a reference of the display apparatus, which is a broad concept including an earth potential. In FIG. 12, the lighting TFT switch 2 is a switch for determining whether a current is made to flow in the OLED element 1, or not. The OLED driving TFT 3 controls the current that flows in the OLED element 1, and determines the gradation of the emission of the OLED element 1. The image data is written in a retention volume 4 from a signal line 54.

When a threshold voltage Vth of the OLED drive TFT 3 is varied, it is impossible to precisely conduct the gradation display. A reset TFT switch 5 in FIG. 12 is used in the reset operation for preventing the electric charges of the retention volume 4 which reflect a data signal from being affected by the threshold voltage Vth. The gradation display that precisely reflects the image data can be conducted by the reset operation.

FIG. 13 is a circuit diagram showing the entire display apparatus using the pixels shown in FIG. 12. The screen is formed by a large number of pixels, but FIG. 13 indicates only four pixels. Scanning signals and the data signals are inputted to the respective pixels by means of a timing controller 110.

A gate driver circuit 200 is located in a lateral direction of the screen. Reset lines 52 and scanning output lines 151 extend from the gate driver circuit 200. Each of the reset lines 52 is connected to the gate of a reset TFT switch 5, and each of the scanning output lines 151 is inputted to a lighting switch OR gate 150. A lighting control line 105 is inputted to the lighting switch OR gates 150. A signal is outputted to the gates of the lighting TFT switches 2 from the lighting switch OR gate 150 according to any one of the signals from the scanning output lines 151 or the signals from the lighting control lines 105.

A signal driver circuit 100 is located above the screen. The image signal is supplied to the signal driver circuit 100 from the external through a signal input line 1001. The signal lines 54 extend toward the screen from the signal driver circuit 100. Not only the image data signal but also a chopping wave from a chopping wave generator circuit 111 are inputted to the signal lines 54. The chopping wave is to determine the emission start times of the respective OLED elements 1 on the basis of the data signal.

FIG. 14 shows a timing chart for driving the driver circuit of FIG. 12. The driver circuit divides one frame into a write operation period, an emission period, and a blanking period as shown in the upper portion of FIG. 1. The gradation signal is written in each of the pixels in the write operation period. The write operation position in FIG. 14 shows an appearance in which the data is written in the order of the scanning lines. The lower portion of FIG. 14 shows a write timing of one pixel. In FIG. 14, the reset TFT switch 5 first turns on to short-circuit the gate and source of the OLED drive TFT 3. Thereafter, the lighting TFT switch 2 turns on to allow a current to flow in the OLED. In this state, the inverter can be formed by the OLED element 1 and the OLED drive TFT 3. The gate and source of the OLED drive TFT 3 are short-circuited by the reset TFT switch 5. With the above configuration, the gate potential of the OLED drive TFT 3 is set to a point where the source and gate of the OLED drive TFT 3 become identical in the potential with each other on a characteristic curve that determines the relationship of the gate and source of the OLED drive TFT 3. In this case, the gate potential of the OLED drive TFT 3 is uniquely determined according to the threshold voltage Vth of the OLED drive TFT 3. Hereinafter, the gate potential is called "given potential". Since the signal voltage is written in the gate potential, it is possible to remove an influence of the variation of Vth on the OLED drive TFT 3. Thereafter, the reset TFT switch 5 and then the lighting TFT switch 2 are turned off. As a result, electric charges that correctly reflect the signal voltage are stored in the retention volume 4 to enable correct gradation electric charges.

After the write operation has been conducted on all of the scanning lines, the period is shifted to the emission period. The chopping wave is inputted to the retention volume 4 during the write period. As a result, the OLED element 1 emits a light according to the potential that is retained in the gate of the OLED drive TFT 3 with a time difference to conduct the gradation display.

Another example that copes with the variation of Vth of the OLED drive TFT 3 is shown in FIGS. 15 to 17. This example is called "second conventional example". FIG. 15 is a driver circuit of one pixel. In FIG. 15, the OLED drive TFT 3, the lighting TFT switch 2, and the OLED element 1 are connected in series from the power supply line 51. The lighting TFT switch 2 controls whether the light emission of the OLED element 1 is enabled, or not. The OLED drive TFT 3 conducts the gradation display by a voltage that is determined by the electric charges that have been stored in a first retention volume 41 and a second retention volume 42. Similarly, in this case, in order to suppress the emission characteristic of the OLED element 1 from being varied by the variation of Vth of the OLED drive TFT 3, the reset TFT switch 5 is used.

FIG. 16 is a circuit diagram showing the entire display apparatus using the pixels shown in FIG. 15. The screen is formed of a large number of pixels. However, FIG. 16 indicates only four pixels. The scanning signals and the data signals are inputted to the respective pixels by the timing controller 110.

The gate driver circuit 200 is located in the lateral direction of the screen. A select switch line 55, a lighting switch line 53, and a reset line 52 extend from the gate driver circuit 200. The select switch line 55 is connected to the gate of the select switch 6, the lighting switch line 53 is connected to the gate of the lighting TFT switch 2, and the reset line 52 is connected to the gate of the reset TFT switch 5.

The signal driver circuit 100 is located above the screen. The image signal is supplied to the signal driver circuit 100 from the external through the signal input line 1001. The signal line 54 extends from the signal driver circuit 100 toward the screen. The input/output of the signal from the signal line 54 to the pixel is controlled according to the signal line select switch control line 104.

The operation of the driver circuit shown in FIG. 15 will be described with reference to FIG. 17. Since the TFT used in FIG. 17 is of the p-type, the TFT turns on when receiving a negative signal. In the second example, when the gradation voltage is written in each of the pixels, the gradation voltage is maintained for one frame period, and the OLED element 1 emits a light. In FIG. 17, the lighting TFT switch 2 is in an on-state. In this state, the select switch 6 turns on. As a result, it is possible to input data from the signal line 54 to the pixels. Subsequently, when the reset TFT switch 5 turns on, the drain voltage of the OLED drive TFT 3 shown in FIG. 16 and the gate voltage of the OLED drive TFT 3 are forcedly short-circuited. Subsequently, when the lighting TFT switch 2 turns off, the gate potential of the OLED drive TFT 3 converges on a value lower than the supply voltage by Vth of the OLED drive TFT 3. Thereafter, when the reset TFT switch 5 turns off, and the signal voltage is written from the signal line 54, the electric charges that reflect the signal voltage are stored in the second retention volume 42 and the first retention volume 41 regardless of the variation of Vth of the OLED drive TFT 3, to thereby enable the gradation display.

The above techniques are disclosed in JP-A 2003-5709, JP-A 2003-122301, and "Digest of Technical Papers, SID98, pp. 11-14".

SUMMARY OF THE INVENTION

Both of the above conventional arts cancel the variation of the threshold voltage Vth of the OLED drive TFT 3 by using the reset TFT switch 5. In order that the gate potential of the OLED drive TFT 3 in FIG. 12 converges on a given potential, or the gate potential of the OLED drive TFT 3 converges on a value lower than the supply voltage by Vth, a period of time during which the lighting TFT switch 2 and the reset TFT switch 5 turn on at the same time, that is, tc5 in FIG. 14 or tc6 in FIG. 17 must have a sufficiently long period of time, or a current that flows in the OLED drive TFT 3 must be sufficiently large. If not, Vth of the OLED drive TFT 3 cannot be sufficiently compensated, and the precise gradation display cannot be conducted.

In the case where the display has a mode changeover function due to the luminance of the maximum gradation, and has, for example, two modes consisting of a high luminance mode and a standard luminance mode, when display of the high luminance mode is conducted, the period of time during which the lighting TFT switch 2 and the reset TFT switch 5 turn on at the same time may not be long since the current that flows in the LED drive TFT 3 is sufficient. On the other hand, in the case of the standard mode, the current that flows in the OLED drive TFT 3 is not larger than that in the case of the high luminance mode, tc5 in FIG. 14 or tc6 (hereinafter referred to as "reset time") in FIG. 17 requires a given period or longer. Similarly, in the standard mode, since the accurate gradation display is required, it is necessary that the reset time conforms to that in the case of the standard mode.

In particular, in the first conventional example, when the reset time is large, the data write time is increased, and a period of time during which the OLED element 1 emits a light to form an image is limited. Even in this case, since the luminance of the screen is required, a large current flows particularly in the high luminance mode. When a large current flows, a voltage is changed by the wiring resistance within the screen, and the brightness is uneven between the upper and lower portions of the screen as shown in FIG. 18. On the other hand, in the second conventional art, when a long period of time is allocated to the reset period, the period of time of the write operation with respect to the respective pixels is increased with the result that the blanking time is not taken. In this case, there arises such a problem that it is impossible to measure the emission characteristic of the respective OLED elements 1 by the use of the blanking period.

The present invention has been made to solve the above-described problems, and therefore an object of the present invention is to cope with the uneven luminance of the screen particularly in the high luminance mode, by not only changing the supply voltage but also changing a driving method in the standard mode and the high luminance mode. The specific means is stated below.

(1) An image display apparatus, comprising: a display unit having a plurality of pixels with light emitting elements formed in a matrix; a display signal driving unit that drives a signal line and a display signal voltage for inputting a display signal voltage to a pixel region; a control line for inputting a drive control signal to the pixel region; a control signal driving unit for driving the drive control signal; and a field effect transistor for driving the light emitting elements on the basis of a display signal that is inputted to the pixels through the signal line, wherein the control signal driving unit has means for changing the drive control signal according to a voltage or a signal related to a plurality of light emission luminance.

(2) The image display apparatus according to the item (1), wherein the light emitting element comprises an organic light emitting diode (OLED) element.

(3) The image display apparatus according to the item (1), wherein the field effect transistor is disposed on a transparent substrate with the use of a polysilicon TFT (thin film transistor).

(4) The image display apparatus according to the item (1), wherein the pixel has switch means that is connected with a detector circuit that can measure a current-to-voltage characteristic of the light emitting element.

(5) The image display apparatus according to the item (4), wherein the display apparatus can display a first luminance mode and a second luminance mode that is higher in the luminance than the first luminance mode, and applies a given voltage from the external to a gate electrode of the field effect transistor by using the switch means in an initial stage where an image signal is written in the pixel at the time of the first luminance mode.

(6) The image display apparatus according to the item (4), wherein the light emitting element comprises an organic light emitting diode (OLED) element.

(7) The image display apparatus according to the item (4), wherein the field effect transistor and the switch means are disposed on a transparent substrate with the use of a polysilicon TFT (thin film transistor).

(8) An image display apparatus, comprising: a display unit that is formed of a plurality of pixels with light emitting elements; a signal line that inputs a display signal to a pixel region; a display signal driving unit that drives a display signal voltage; a control line for inputting a drive control signal to the pixel region; a control signal driving unit for driving the drive control signal; and a field effect transistor for driving the light emitting element on the basis of an image data signal that is inputted to the pixel through the signal line, wherein the field effect transistor has a source electrode applied with a reference potential, a gate electrode connected with first switch means for connecting the gate and drain of the field effect transistor to each other and a capacitor, and a drain electrode connected with third switch means for controlling the supply of a current on the basis of the image data signal to the light emitting element, wherein the light emitting element has an anode and a cathode, and the anode is connected with the third switch means and second switch means for applying a given voltage from the external, and wherein the control signal driving unit has means for changing the drive control signal according to a voltage or a signal related to a plurality of light emitting luminance.

(9) The image display apparatus according to the item (8), wherein the second switch means controls a connection to a detector circuit that can measure the current-to-voltage characteristic of the light emitting element.

(10) The image display apparatus according to the item (8), wherein the display apparatus can display a first luminance mode and a second luminance mode that is higher in the luminance than the first luminance mode, and applies a given voltage from the external to a gate electrode of the field effect transistor by using the switch means in an initial stage where an image signal is written in the pixel at the time of the first luminance mode.

(11) The image display apparatus according to the item (8), wherein the light emitting element comprises an organic light emitting diode (OLED) element.

(12) The image display apparatus according to the item (8), wherein the field effect transistor and the switch means are disposed on a transparent substrate with the use of a polysilicon TFT (thin film transistor).

(13) An image display apparatus, comprising: a display unit that is formed of a plurality of pixels with light emitting elements; a signal line that inputs a display signal to a pixel region; a display signal driving unit that drives a display signal voltage; a control line for inputting a drive control signal to the pixel region; a control signal driving unit for driving the drive control signal; and a field effect transistor for driving the light emitting element on the basis of an image data signal that is inputted to the pixel through the signal line, wherein the field effect transistor has a source electrode applied with a reference potential, a gate electrode connected with a reset switch for connecting the gate and drain of the field effect transistor to each other and a capacitor, and a drain electrode connected with third switch means for controlling the supply of a current on the basis of the image data signal to the light emitting element, wherein the light emitting element has an anode and a cathode, and the anode is connected with the third switch means and second switch means for applying a given voltage from the external, and wherein the control signal driving unit has means for changing the drive control signal according to a voltage or a signal related to a plurality of light emitting luminance.

(14) The image display apparatus according to the item (13), wherein the second switch means controls a connection to a detector circuit that can measure the current-to-voltage characteristic of the light emitting element.

(15) The image display apparatus according to the item (13), wherein the display apparatus can display a first luminance mode and a second luminance mode that is higher in the luminance than the first luminance mode, and applies a given voltage from the external to a gate electrode of the field effect transistor by using the switch means in an initial stage where an image signal is written in the pixel at the time of the first luminance mode.

(16) The image display apparatus according to the item (13), wherein the light emitting element comprises an organic light emitting diode (OLED) element.

(17) The image display apparatus according to the item (13), wherein the field effect transistor and the switch means are disposed on a transparent substrate with the use of a polysilicon TFT (thin film transistor).

According to the present invention, even in the case of the standard mode, a period of time of the reset operation for resetting the gate voltage of the OLED drive TFT can be reduced. At the same time, the uneven luminance can be prevented in the case of the high luminance mode. Also, a period of time that has been saved by shortening the reset time is used, for example, in the characteristic inspection of the respective OLED elements, which can be effective to the feedback of the luminance adjustment.

DETAILED DESCRIPTION OF THE PREFERRED EMBODIMENTS

Now, a description will be given in more detail of preferred embodiments of the present invention with reference to the accompanying drawings.

First Embodiment

Figure 1:
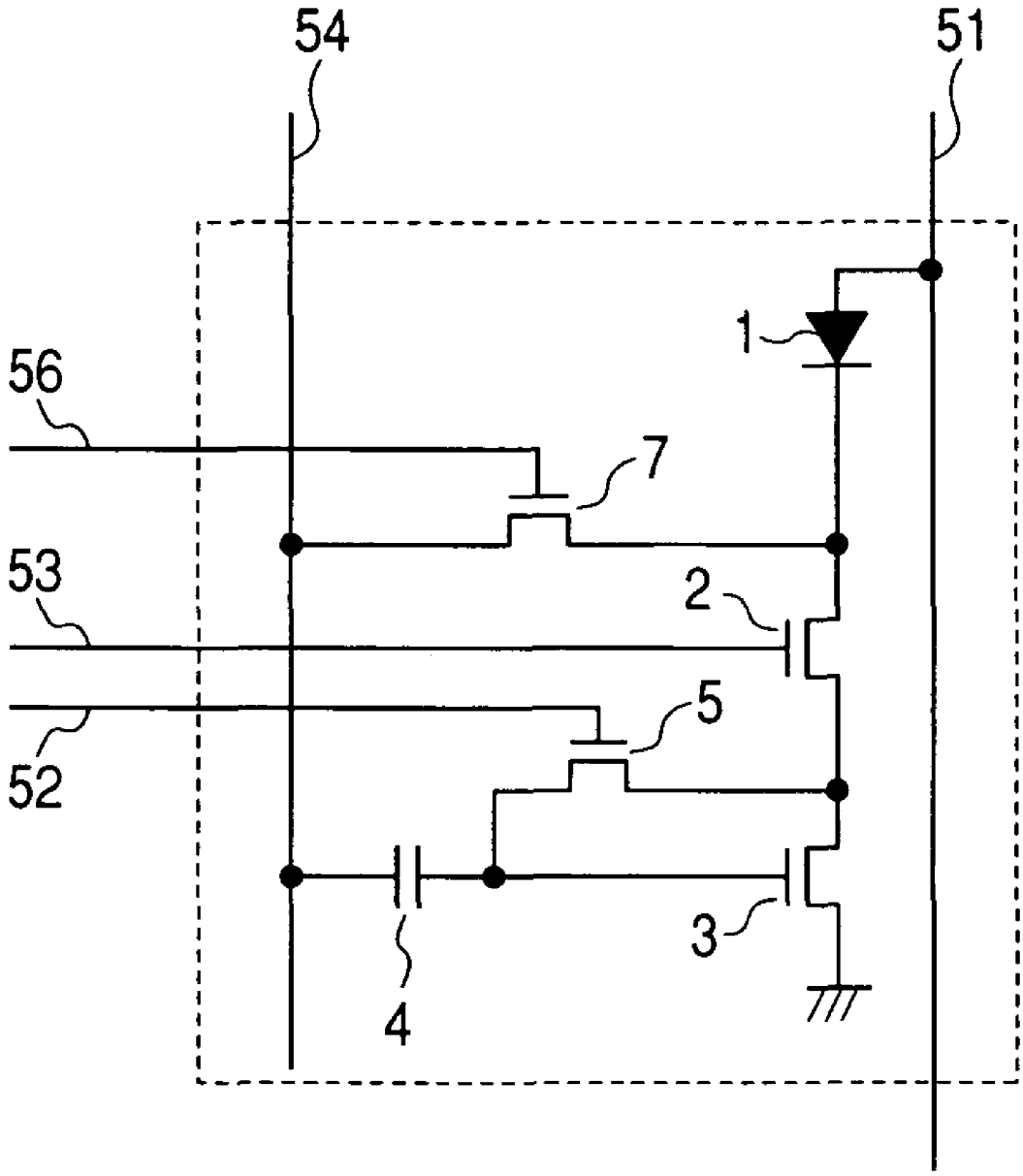
FIG. 1 is a diagram showing a pixel unit driver circuit according to a first embodiment.

FIG. 1 is a circuit diagram showing a pixel structure according to the present invention. The circuit shown in FIG. 1 according to the present invention copes with the problems with the first conventional example of the prior art. The basic operation of FIG. 1 is identical with that in the first conventional example. That is, referring to FIG. 1, an OLED element 1, a lighting TFT switch 2, and an OLED drive TFT 3 are connected in series between a power supply line 51 and a reference potential. Referring to FIG. 1, the lighting TFT switch 2 is a switch that determines whether a current is allowed to flow in the OLED element 1, or not, and an OLED drive TFT 3 controls a current that flows in the OLED element 1 to determine the gradation of light emission of the OLED element 1. Image data is written in a retention volume 4 from a signal line 54.

Also, the reset operation is also identical with that in the first conventional example. That is, as described in the first conventional example, the reset TFT switch 5 in FIG. 1 sets the gate potential of the OLED drive TFT 3 to a potential that compensates the threshold voltage Vth of the OLED element 3. As a result, the gradation display that precisely reflects the image data signal is enabled.

In order to set the gate potential of the OLED drive TFT 3 to a given value, it is necessary that a product of a current which flows in the OLED drive TFT 3 and the reset time is equal to or larger than a given value. In the case of the standard mode, because the current that flows in the OLED drive TFT 3 is smaller than that in the high luminance mode, the reset time is determined in accordance with the standard mode.

In this embodiment, the Vth reset method is changed between the standard mode and the high luminance mode to suppress an increase in the write time, as a result of which the light emission time of the OLED element 1 can be sufficiently taken. This embodiment solves the problems with the conventional art by using a precharge control line 56 and a preset TFT switch 5 as shown in FIG. 1. That is, only at the time of the standard mode that requires much time for resetting, the precharge operation is conducted to shorten the reset time.

Figure 2:
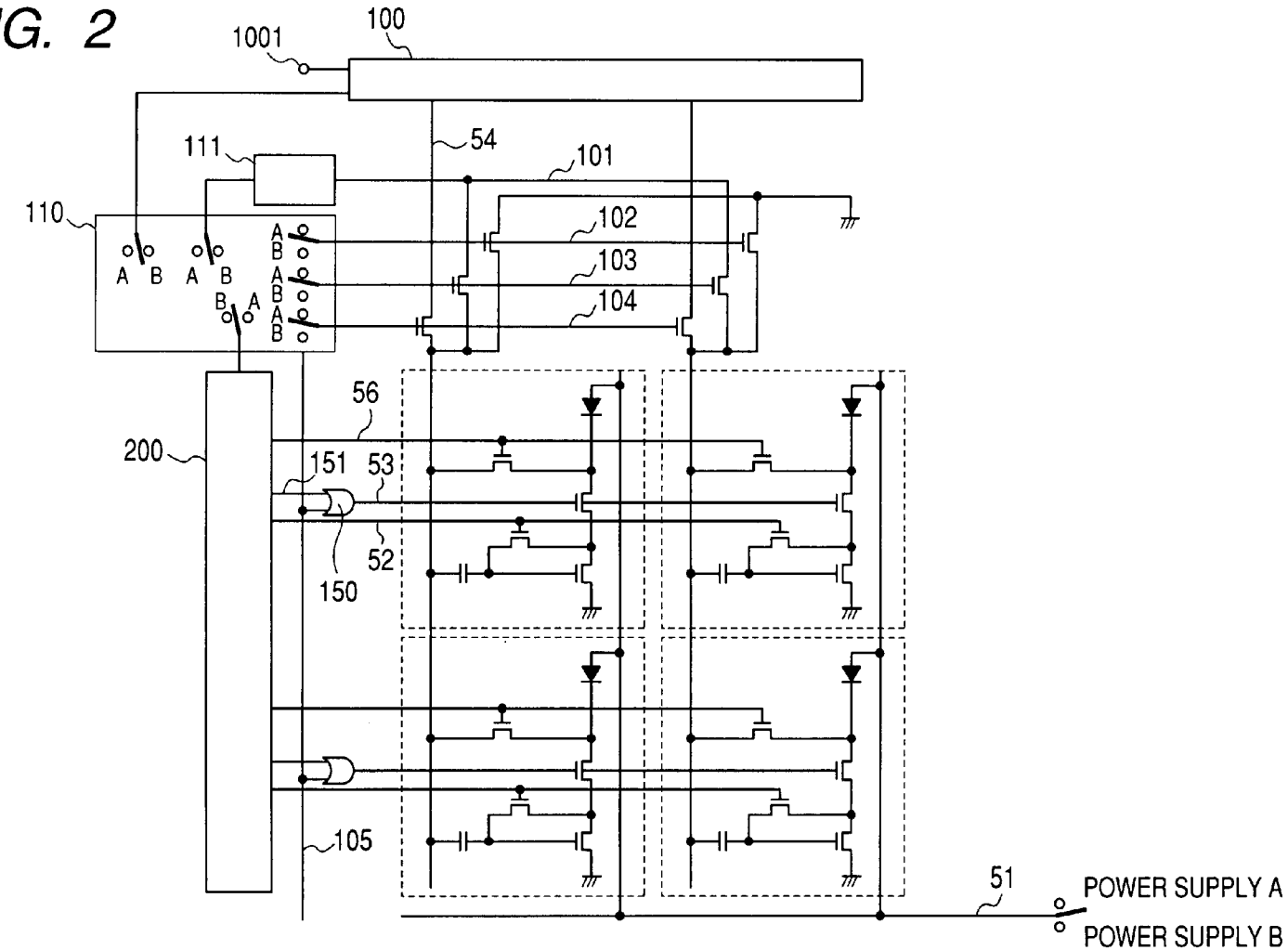
FIG. 2 is a diagram showing a display apparatus driver circuit according to the first embodiment.

FIG. 2 is a circuit diagram showing the entire display apparatus using the pixels shown in FIG. 1. A screen is formed of a large number of pixels, but FIG. 2 indicates only four pixels. The scanning signal and the data signal are inputted to the respective pixels by the timing controller 110. In this example, in the case where the standard mode is selected by the mode changeover, the switch is set to a power supply A shown in FIG. 2. At the same time, the respective switches within the timing controller are also set to the power supply A. Also, in the case where the high luminance mode is selected by the mode changeover, a power supply B is selected in FIG. 2. At the same time, the switches within the timing controller are also set to the power supply B.

A gate driver circuit 200 is located in a lateral direction of a screen. A reset line 52, a scanning output line 151, and a precharge control line 56 extend from the gate driver circuit 200. The reset line 52 is connected to the gate of the reset TFT switch 5, and the scanning output line 151 is inputted to a lighting switch OR gate 150. The lighting switch OR gate 150 is input with a lighting control line 105, and a signal is outputted to the gate of the lighting TFT switch 2 from the lighting switch OR gate 150 according to any one of the signal from the scanning output line 151 or the signal from the lighting control line 105. The precharge control line 56 is connected to the gate of the precharge TFT switch 7. A chopping wave that is generated in the chopping wave generator circuit 111 is connected to the signal line 54 through the chopping wave input line 101. As will be described later, the chopping wave is added to the input of the respective pixels in a light emitting period after the data signal has been written in all of the pixels. The input of the chopping wave to the signal line is controlled by a chopping wave select switch control line 103.

The signal driver circuit 100 is located above the screen. An image signal is supplied to the signal driver circuit 100 from the external through a signal input line 1001. The signal line 54 extends from the signal driver circuit 100 toward the screen. Not only the image data signal but also the chopping wave from the chopping wave generator circuit 111, and the precharge potential are supplied to the signal line 54 with a time difference. The supply timings of the respective voltages to the signal line 54 are conducted through the signal line select switch control line 104, the signal wave select switch control line 103, and the precharge switch control line, respectively.

Figure 3:
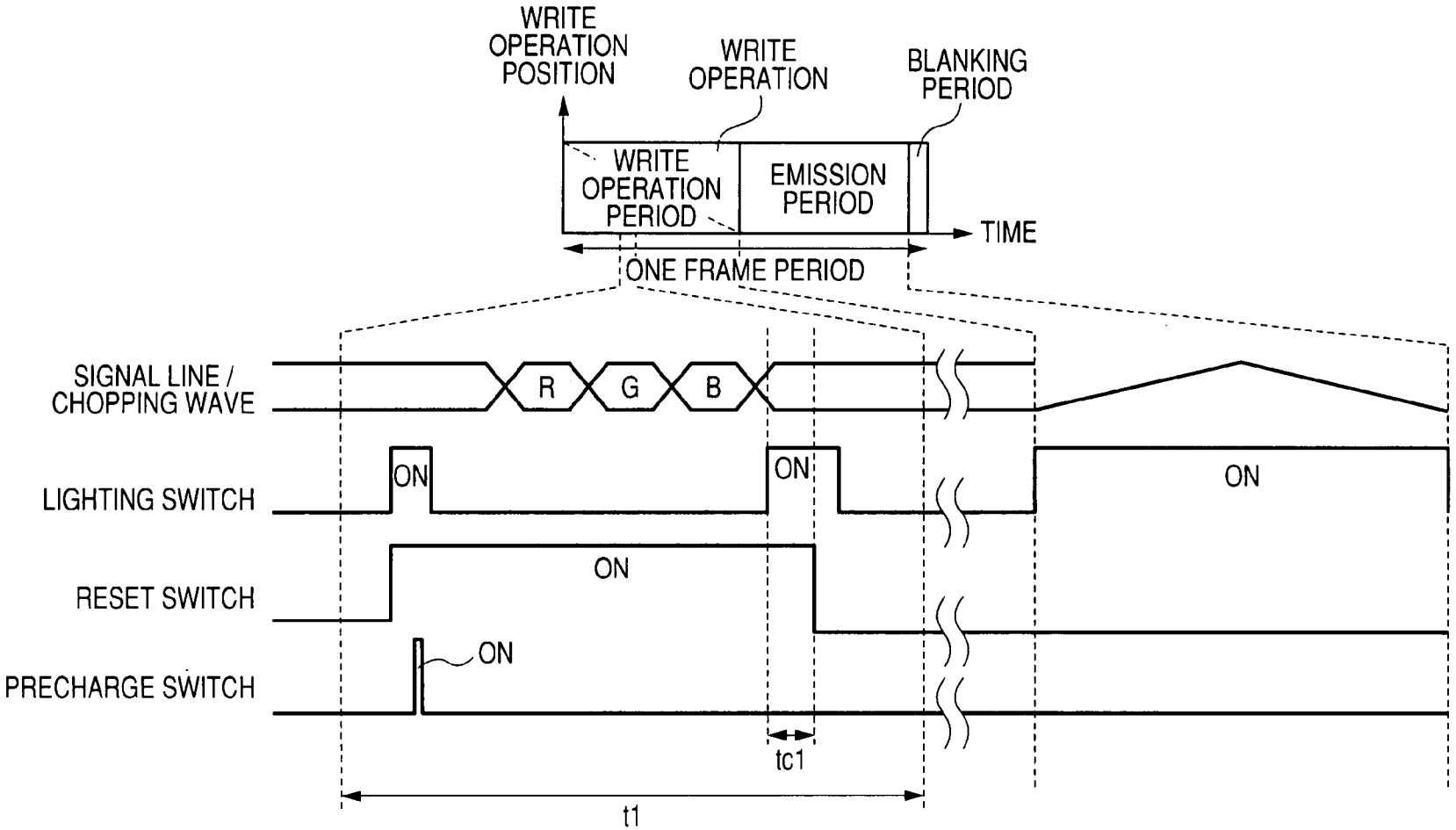
FIG. 3 is a timing chart in a standard mode according to the first embodiment.

FIG. 3 is a timing chart when the standard mode is selected. The upper side of FIG. 3 shows the operation in one frame period. One frame period is divided into a write operation period, a light emitting period, and a blanking period. The write operation period is a period during which the image data is taken in the pixel from the signal line 54 and held. The light emitting period is a period during which the pixels of the entire screen emit lights to display an image. Also, the blanking period can be, for example, used for the operation of measuring the characteristic of the individual OLED elements 1 and storing the characteristic in order to feedback the display data.

A lower side of FIG. 3 shows the operation timing chart in the respective pixels. A time t1 in FIG. 3 shows a write time of one pixel. In FIG. 3, the operation of setting the gate voltage of the OLED drive TFT 3 to a given value is conducted during a period tc1 shown in FIG. 3 which is a period during which the lighting TFT switch 2 and the reset TFT switch 5 turn on at the same time.

In the conventional art, in the initial stage of tc1, the gate voltage of the OLED drive TFT 3 is unstable, and can take a value of form the supply potential to the reference potential. When the current or the time tc1 at the time of reset is sufficient, the gate voltage of the OLED drive TFT 3 converges on a given value during the reset operation. However, in the standard mode, the current that flows in the OLED drive TFT 3 is not large, and in the time of tc1 shown in FIG. 3, the gate voltage of the OLED drive TFT 3 does not converge on a given value. It is assumed that the gate voltage is a divergent voltage ΔV. The divergent voltage ΔV is different between a case where the initial potential before the OLED drive TFT 3 is reset is close to the supply potential and a case where the initial potential is close to the reference potential. In the case where the initial value before the gate voltage of the OLED drive TFT 3 is reset is close to the supply potential, the gate voltage after the reset operation becomes, for example, a given voltage +ΔV1. On the other hand, in the case where the initial value before the gate voltage of the OLED drive TFT 3 is reset is close to the reference potential, the gate voltage becomes, for example, a given potential −ΔV2. That is, the gate potential of the OLED drive TFT 3 is varied within a range of ΔV1+ΔV2 after the reset. Accordingly, the precise gradation display cannot be conducted.

According to the present invention, when the current value is not large as in the standard mode, the gate potential of the OLED drive TFT 3 before the reset is set to, for example, about the reference potential by the precharge operation that will be described later. With the above operation, even if the unreset voltage occurs after the reset operation, the unreset voltage is slightly varied in the vicinity of a given potential −ΔV2, and the variation of the gate potential of the OLED drive TFT 3 becomes remarkably small as compared with that in the conventional art, to thereby enable the more precise gradation display.

Hereinafter, the operation of the standard mode in this embodiment will be described with reference to FIG. 3. First, the reset TFT switch 5 turns on, and at the same time, the lighting TFT switch 2 turns on for a short period of time. The precharge TFT switch 7 turns on for a short period of time during a period where the lighting TFT switch 2 turns on. With the above operation, the gate potential of the OLED drive TFT 3 in FIG. 1 is forcedly set to about the earth potential. Thereafter, the lighting TFT switch 2 turns off. During that time, the data signal is written in the retention volume 4 shown in FIG. 1 from the signal line 54. Thereafter, the lighting TFT switch 2 again turns on to reset the OLED drive TFT 3. The reset operation is conducted during the period tc1 where the lighting TFT switch 2 and the reset TFT switch 5 are on at the same time. The voltage before the gate voltage of the OLED drive TFT 3 is reset is set to about the reference potential. Therefore, the tc1 is not a sufficient period for the reset operation, and even if the divergent ΔV2 occurs, the gate potential of the OLED drive TFT 3 is slightly varied in the vicinity of a given potential −ΔV2. Accordingly, the variation in the gradation display is greatly improved.

The above operation is conducted on all of the pixels in each of the scanning lines, and the image data is written in all of the pixels. Thereafter, the period is shifted to the light emitting period of the OLED element 1. The image is displayed in the light emitting period. During the light emitting period, the chopping wave is inputted to each of the signal lines 54, and the chopping wave is transmitted to the each gate of the OLED drive TFTs 3 through the retention volume 4. The data has the potential corresponding to the image data that has been written in the write period. With the input of the chopping wave, the gate potential of the OLED drive TFT 3 allows the OLED drive TFT 3 to turn on according to the gate potential that has been written in advance. The pixel that is larger in the luminance allows the OLED drive TFT 3 to turn on quickly whereas the pixel that is smaller in the luminance allows the OLED drive TFT 3 to turn on lately. As a result, the gradation display is conducted. The blanking period in FIG. 3 can be used, for example, to inspect the light emitting characteristic of the OLED element 1.

Figure 4:
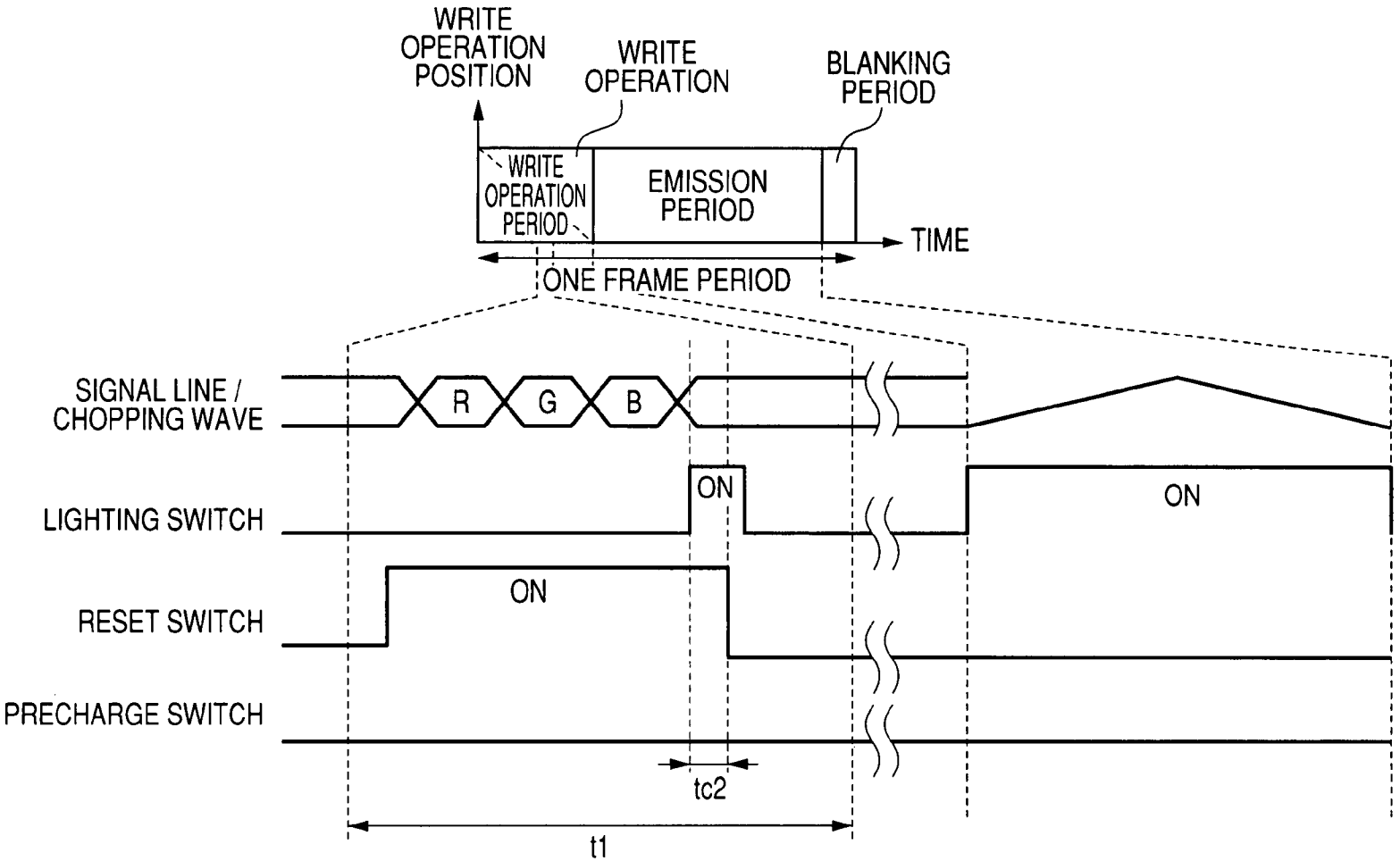
FIG. 4 is a timing chart in a high luminance mode according to the first embodiment.

FIG. 4 is a timing chart showing the operation of the respective pixels when the high luminance mode is selected. The upper side of FIG. 4 shows the operation in one frame period. As in the standard mode, one frame period is divided into a write operation period, a light emitting period, and a blanking period. The write operation period is a period during which the image data is taken in the pixel from the signal line 54 and held. The light emitting period is a period for displaying an image. Also, the blanking period can be, for example, used for the operation of measuring the characteristic of the individual OLED elements 1 and storing the characteristic in order to feedback the display data. A lower side of FIG. 4 is a timing chart showing the operation of the respective pixels. A time t2 in FIG. 4 shows a write time of one pixel in the high luminance mode. As shown in FIG. 4, the precharge operation is not conducted in the high luminance mode. The reset operation of the OLED drive TFT 3 is conducted during the period tc2 in FIG. 4 which is a period during which the lighting TFT switch 2 and the reset TFT switch 5 turn on at the same time. In the high luminance mode, because a current that flows in the OLED element 1 or the OLED drive TFT 3 is large, the gate potential of the OLED drive TFT 3 can converge on a given potential during a time tc2. Accordingly, the accurate gradation display can be conducted even if the precharge operation is not conducted.

After the pixel data has been written in all of the pixels, the chopping wave is inputted to the signal line 54, and the respective pixels are allowed to emit a light according to the written image data like the standard mode.

Figure 5:
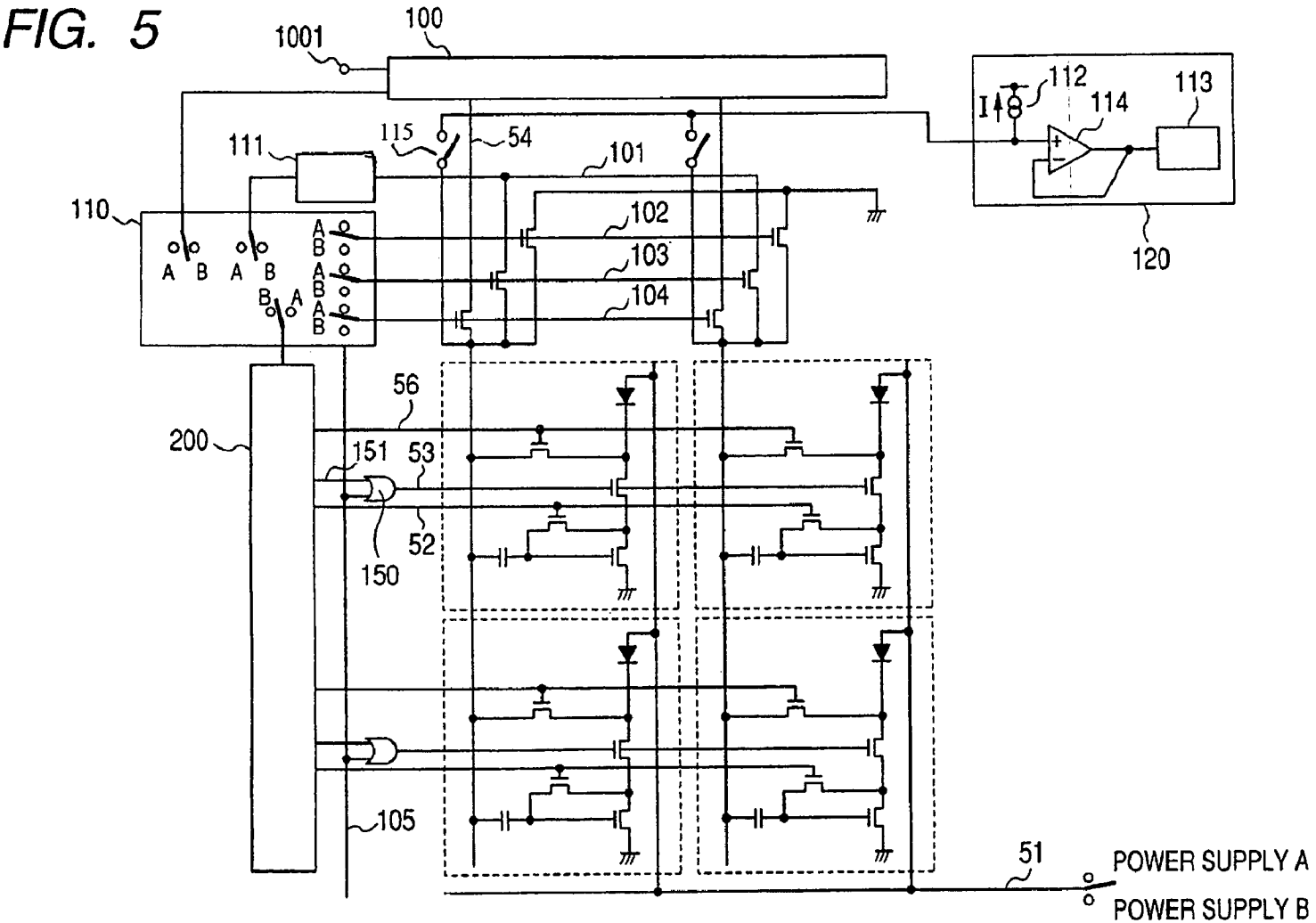
FIG. 5 is a circuit diagram adding a detection system to the display apparatus driver circuit according to the first embodiment.

FIG. 5 shows an example of measuring the current-voltage characteristic of the OLED element 1 during the blanking period according to this embodiment. The OLE element 1 has such a characteristic that the light emitting characteristic is deteriorated with the operation time. Because a rate of the deterioration of the light emitting characteristic is different according to the respective OLED elements 1, the image display cannot be precisely conducted unless the deterioration characteristic in each of the pixels reflects on the image data that has been transmitted from the external. The feedback is the operation of first measuring the deterioration characteristic of the respective pixels, recording the measured deterioration characteristic in the memory 113, and feeding back the data in the image data.

The deterioration of the OLED element 1 appears as the phenomenon that the current that flows in the OLED element 1 is small. In other words, the phenomenon is that the voltages of the anode and the cathode of the OLED element 1 become large when the same current flows in the OLED element 1. In this embodiment, as shown in FIG. 5, the current flows in the respective OLED elements 1 from a constant current source 112, and a voltage between the terminals of the OLED element 1 is measured to measure the deterioration characteristic of the OLED element 1. The operation is conducted during the blanking period of FIG. 3 or 4.

Referring to FIG. 5, there is located a detection system 120 that includes a current source 112, a buffer amplifier 114, and a memory 113. The detection line that is output from the detection system 120 is connected to a signal line 54 through a detection switch 115. When the light emitting period is terminated and shifted to the blanking period, the detection switch 115 turns on, and a current flows in the OLED element 1 of the pixel from the current source 112. In this situation, the current is allowed to flow by turning on the precharge TFT switch 7. The current flows from the OLED element 1 toward the current source 112. The voltage between the terminals of the OLED element 1 is measured, thereby making it possible to measure the deterioration characteristic of the OLED element. The current-to-voltage characteristic of the OLED element 1 is recorded in the memory 113, and fed back to a subsequent data write with respect to the pixel. The current-to-voltage characteristic is conducted on all of the pixels. All of the measurements are not conducted in the blanking period within one frame, but is divided into plural frames to conduct the measurement.

Referring to FIG. 5, all of the switches for the precharge control line 56, the chopping wave supply line 101, and the signal line 54 turn off during the blanking period. The configuration of FIG. 5 other than the above measurement system is identical with that of FIG. 2. The characteristic measurement of the OLED element 1 during the blanking period can be conducted regardless of the standard mode and the high luminance mode.

Second Embodiment

Figure 6:
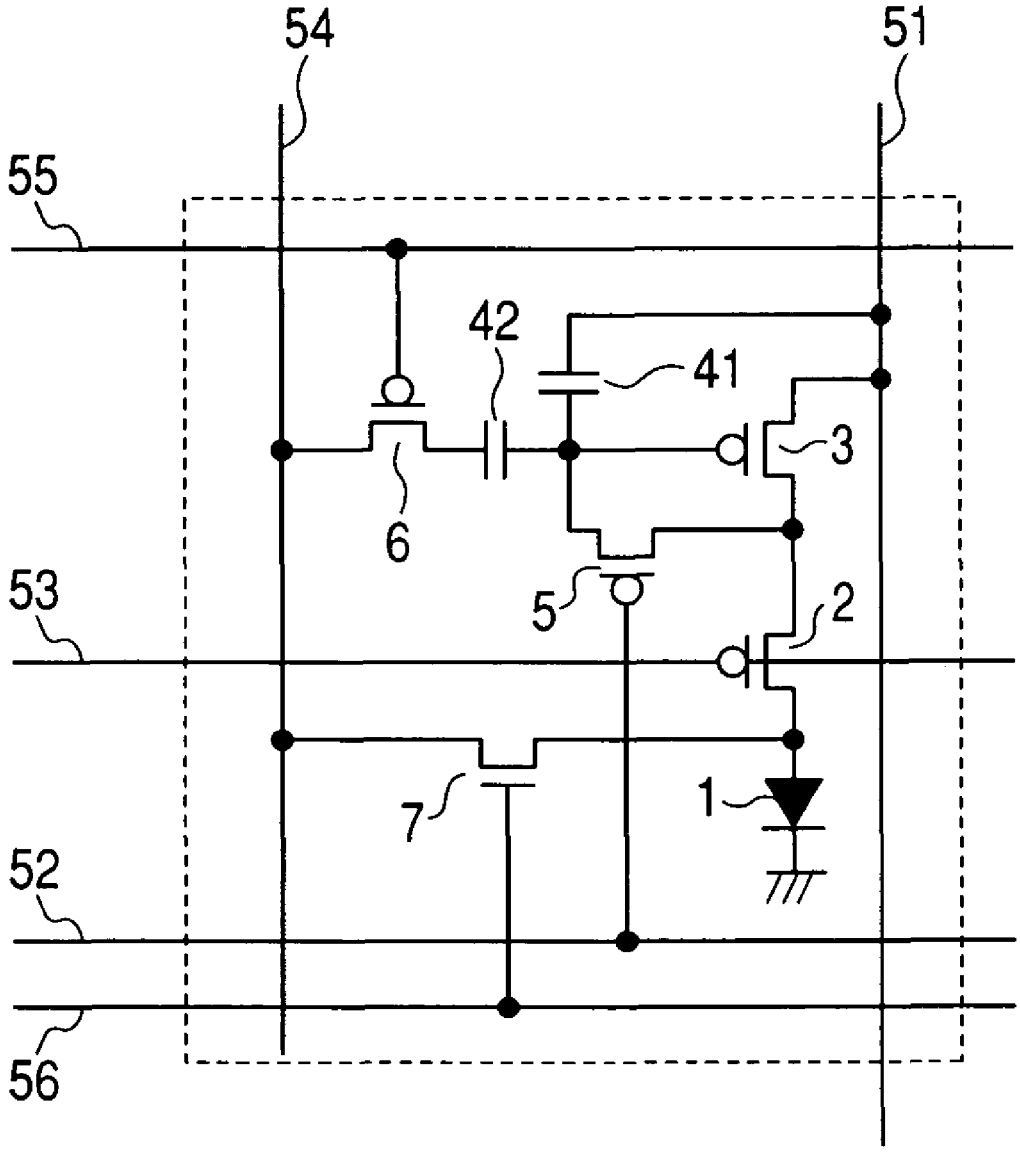
FIG. 6 is a diagram showing a pixel unit driver circuit according to a second embodiment.

FIG. 6 is a circuit diagram showing a pixel structure according to a second embodiment of the present invention. Referring to FIG. 6, the OLED drive TFT 3, the lighting TFT switch 2, and the OLED element 1 are connected in series from the power supply line 51. The lighting TFT switch 2 is allowed to control whether the light emission of the OLED element 1 is enabled, or not. The OLED drive TFT 3 conducts the gradation display by a voltage that is determined by the electric charges that have been stored in the first retention volume 41. Similarly, in this case, in order to suppress the light emitting characteristic of the OLED element 1 from being varied by a variation of Vth of the OLED drive TFT 3, the reset TFT switch 5 is used. The above configuration is identical with that described in the second conventional example. In the present invention, the drain of the precharge TFT switch 7 that is controlled by the precharge control line 56 is connected to the anode of the OLED element 1 in addition to the above configuration. As will be described later, the precharge TFT switch 7 is turned on for a short period of time before resetting, thereby setting the gate potential of the OLED drive TFT 3 before resetting to be close to the reference potential.

Figure 7:
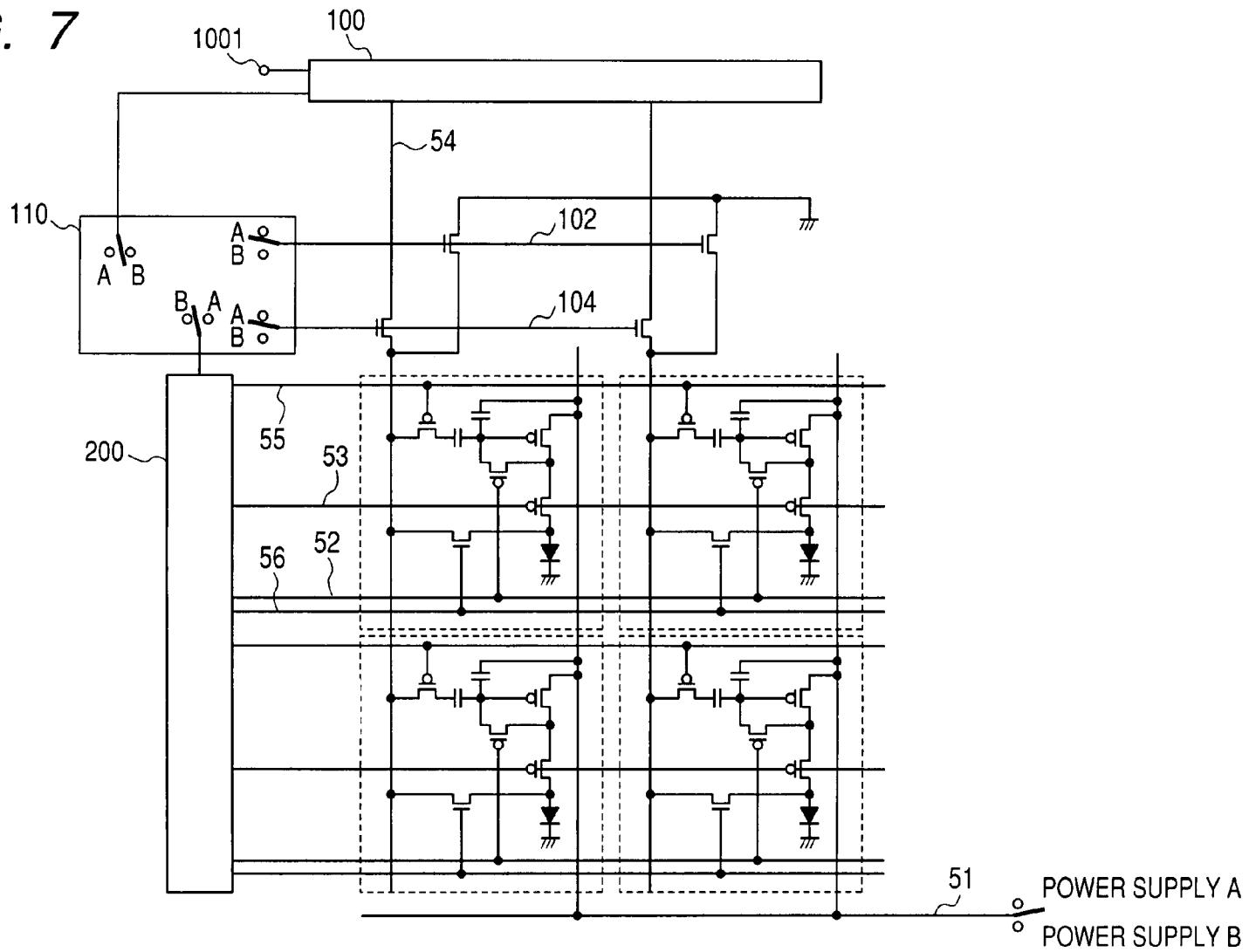
FIG. 7 is a diagram showing a display apparatus driver circuit according to the second embodiment.

FIG. 7 is a circuit diagram showing the entire display apparatus using the pixels shown in FIG. 6. A screen is formed of a large number of pixels. But FIG. 7 indicates only four pixels. The scanning signal and the data signal are inputted to the respective pixels by the timing controller 110.

A gate driver circuit 200 is located in a lateral direction of a screen. A select switch line 55, a lighting switch line 53, a reset line 52, and a precharge control line 56 extend from the gate driver circuit 200. The select switch line 55 is connected to the gate of the select switch 6 of the pixel, the lighting switch line 53 is connected to the gate of the lighting TFT switch 2, the reset line 52 is connected to the gate of the reset TFT switch 5, and the precharge control line 56 is connected to the gate of the precharge TFT switch 7.

A signal driver circuit 100 is located above the screen. The image signal is supplied to the signal driver circuit 100 from the external through the signal input line 1001. The signal line 54 extends from the signal driver circuit 100 toward the screen. The input/output of the signal from the signal line 54 with respect to the pixel is controlled by the signal line select switch control line 104. The signal line select switch control line 104 as well as a precharge signal select line 102 that controls the precharge supply line that is connected to the reference potential exist between the signal driver circuit 100 and the screen.

In the case of the standard operation, for example, the power supply line 51 is connected to the power supply A. With the connection to the power supply A, the switch within the timing controller is also set to A. In the case of the high luminance mode, the power supply line 51 is connected to the power supply B. With the connection to the power supply B, the switch within the timing controller is also set to B.

Figure 8:
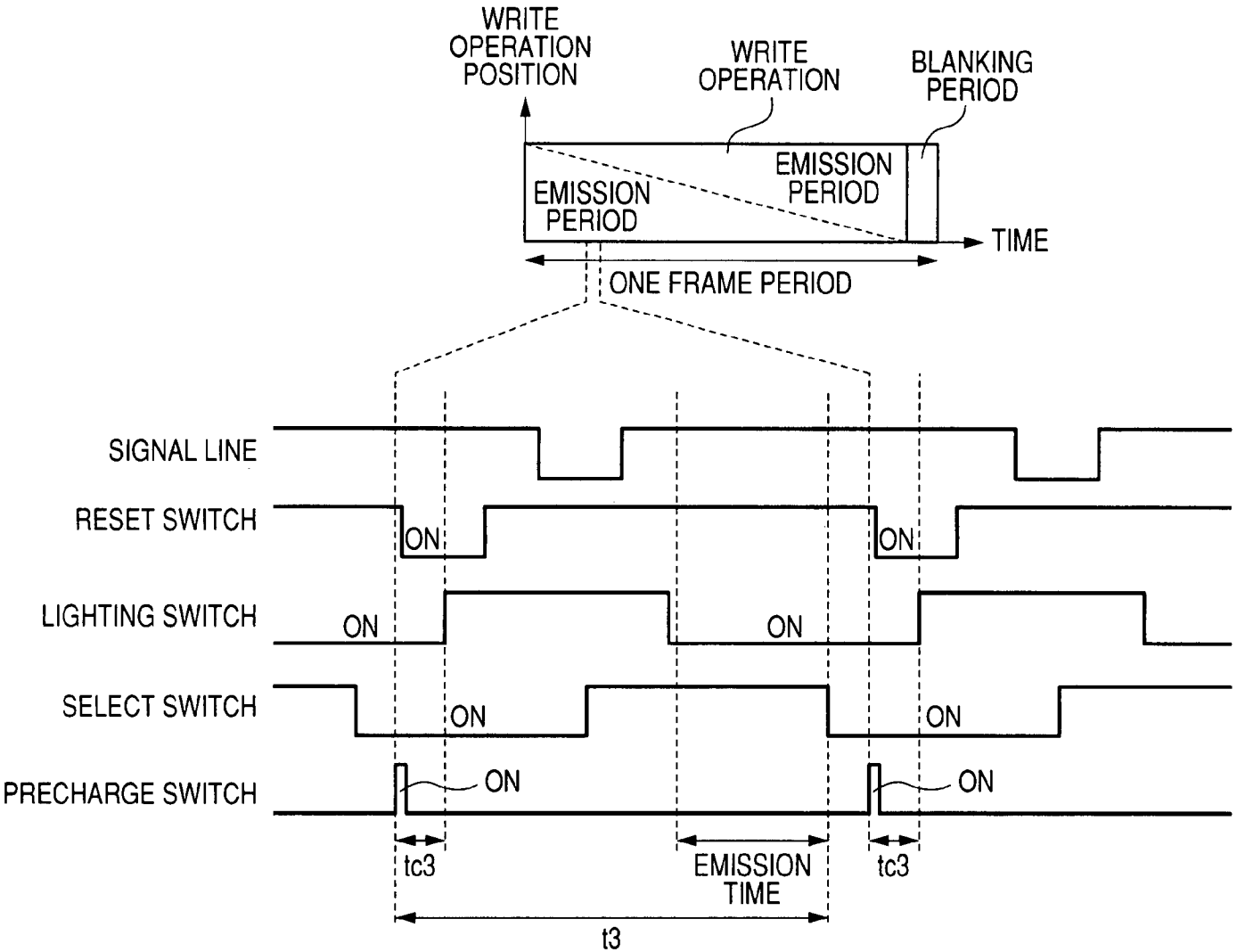
FIG. 8 is a timing chart in a standard mode according to the second embodiment.

FIG. 8 is a timing chart in the case of the standard operation. The operation circuit in FIGS. 6 and 7 will be described with reference to FIG. 8. Referring to FIG. 8, since all of the switches are of p-type TFT except for the precharge TFT switch 7, the TFTs turn on when receiving a negative signal in those switches. In this embodiment, unlike the first embodiment, when the gradation voltage is written in each of the pixels, the gradation voltage is maintained for one frame period, and the OLED element 1 emits a light. In FIGS. 7 and 8, the lighting TFT switch 2 is in an on-state. In this state, the select switch 6 turns on. As a result, it is possible to input the data from the signal line 54 to the pixel. Subsequently, the precharge switch turns on simultaneously when the reset TFT switch 5 turns on. With the above operation, in an initial stage of the reset operation, the gate potential of the OLED drive TFT 3 is forcedly set to be close to the reference potential. That is, because all of the lighting TFT switch 2 and the reset TFT switch 5 are on, those TFTs are in a short-circuit state, and the gate potential of the OLED drive TFTs 3 becomes identical in the potential with the anode of the OLED element 1.

Subsequently, the lighting TFT switch 2 turns off. A signal is written in the second retention volume 42 and the first retention volume 41 from the signal line 54 through the select switch 6 while the lighting TFT switch 2 is off. The reset operation is conducted while the lighting TFT switch 2 and the reset switch are on at the same time, that is, during the period tc3 in FIG. 8. Through the reset operation, the gate potential of the OLED drive TFT 3 converges on the value of the supply potential-Vth. In this example, Vth is a threshold voltage of the OLED drive TFT 3. Since the data signal is written on the basis of (supply voltage-Vth), the gradation display can be conducted without being affected by Vh.

However, in order to sufficiently conduct the reset operation so that the gate potential of the OLED drive TFT 3 converges on supply potential-Vth, it is necessary that a product of the period tc3 during which the reset TFT switch 5 and the lighting TFT switch 2 turn on at the same time and a current that flows in the OLED element 1, that is, the OLED drive TFT 3 is a given value or higher as shown in FIG. 8. Because the current that flows in the OLED element 1 is not large, it is necessary to extend the period tc3. When the period tc3 is extended, the write period in each of the pixels is extended. With the above configuration, it is impossible to take the blanking period shown in FIG. 8. The blanking period is a period required to measure the OLED element characteristic for correcting the data signal. Accordingly, it is impossible to eliminate the blanking period. On the other hand, when the period tc3 is shortened in the standard mode, it is impossible to conduct the gradation display as described above.

In this embodiment, the gate potential of the OLED drive TFT 3 in FIG. 6 is forcedly set to the reference potential. It is assumed that the voltage that has not conversed during the reset period is the divergent voltage ΔV. With the above configuration, the gate potential of the OLED drive TFT 3 after the reset operation becomes supply potential-Vth-ΔV, and the variation of the gate potential becomes slight. Accordingly, it is possible to conduct the precise gradation display. That is, according to this embodiment, even in the standard mode, the precise gradation display can be conducted while ensuring the blanking period during one frame.

Figure 9:
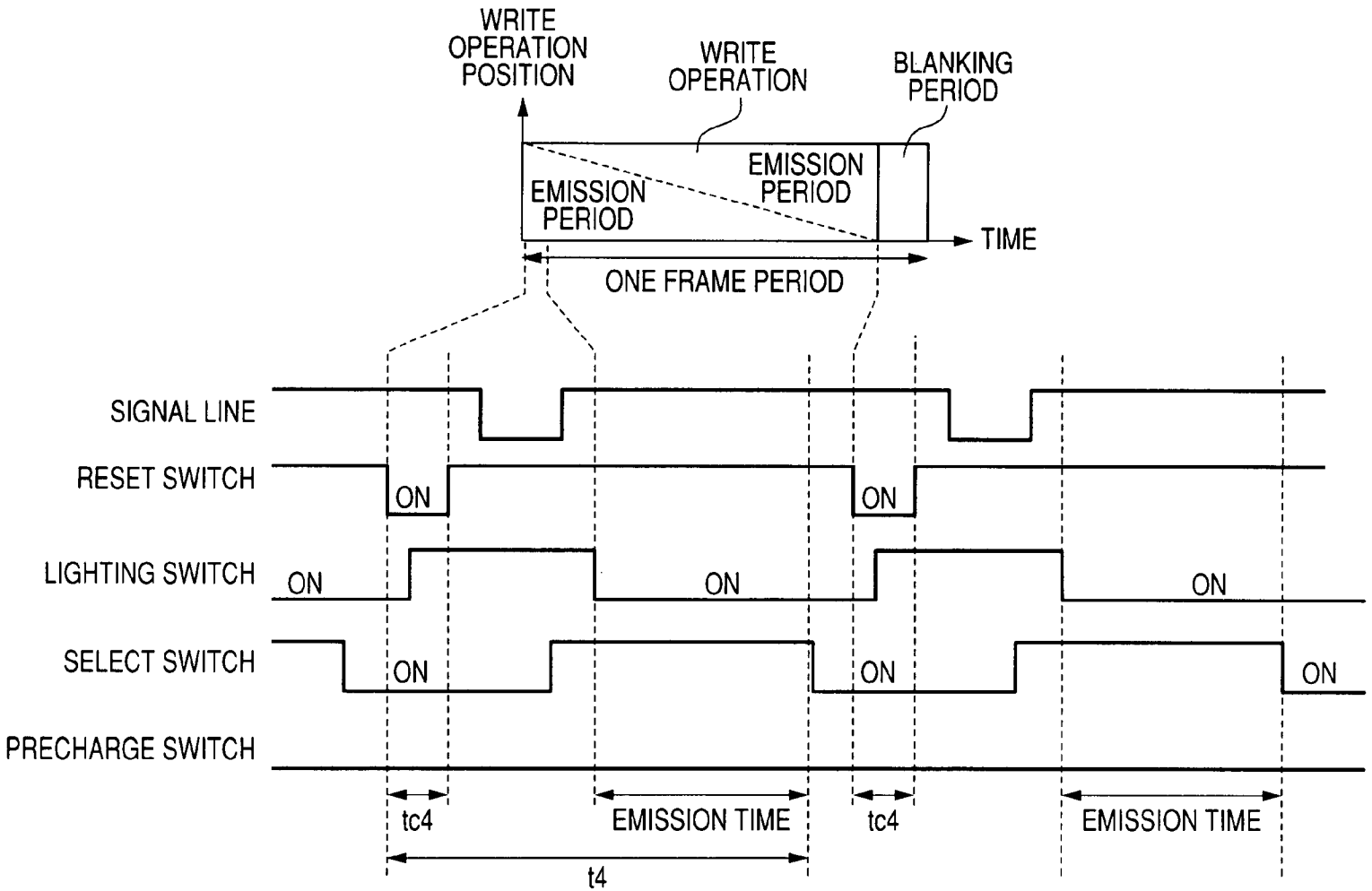
FIG. 9 is a timing chart in a high luminance mode according to the second embodiment.

FIG. 9 is a timing chart in the case of the high luminance mode according to this embodiment. The reset operation is conducted during the period tc4 that is a period during which the reset TFT switch 5 and the lighting TFT switch 2 turn on at the same time. In order that the gate potential of the OLED drive TFT 3 converges on (supply potential-Vth), a product of the current that flows in the OLED element 1 and tc4 must be a constant value or more. In the case of the high luminance mode, since the current that flows in the OLED element 1 is large, the gate potential of the OLED drive TFT 3 can converge on (supply potential-Vth) even if the period tc4 is short. When the period tc4 is short, the blanking period shown in FIG. 9 can be ensured. Accordingly, in the case of the high luminance mode, the precharge operation may not be conducted.

Figure 10:
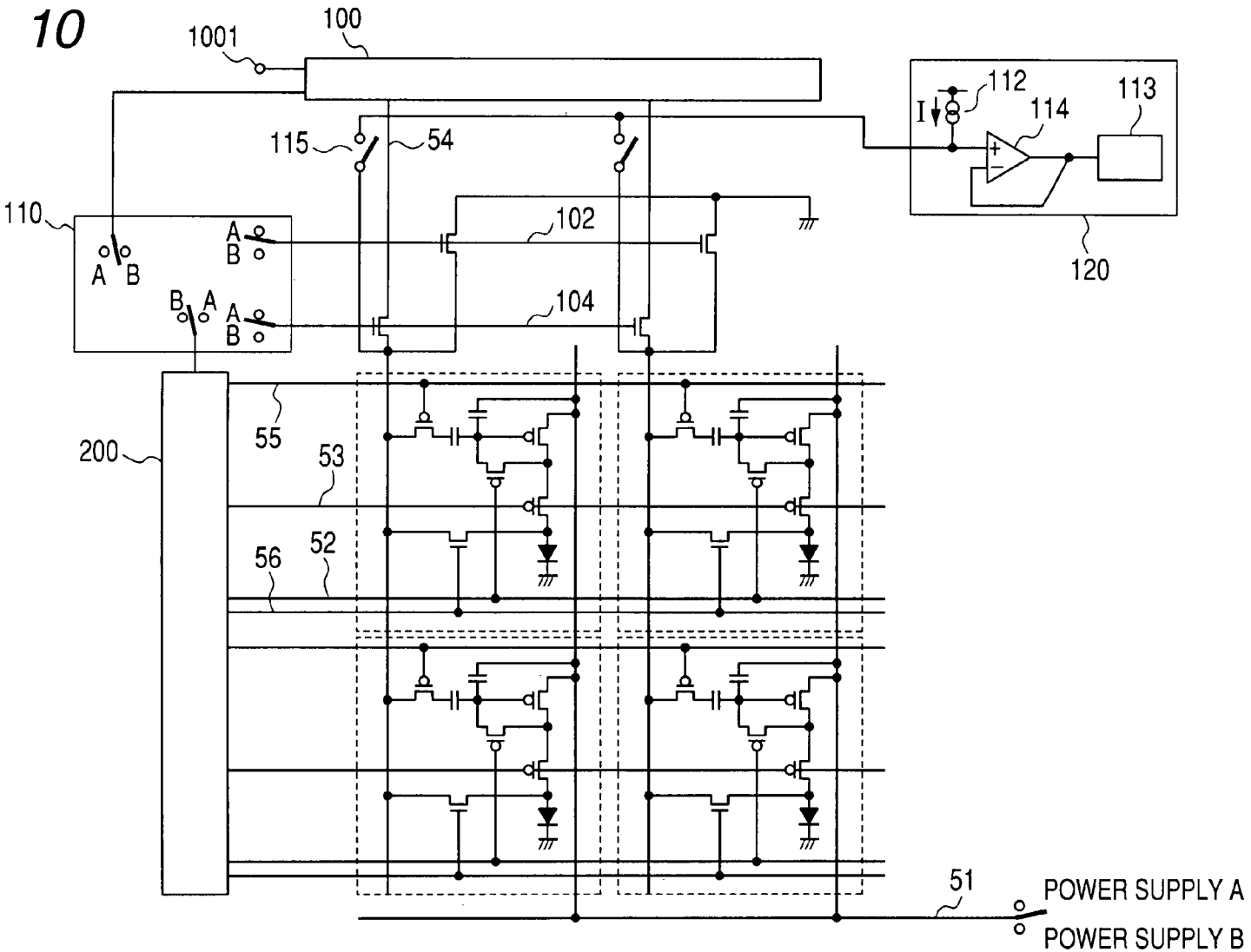
FIG. 10 is a circuit diagram adding a detection system to the display apparatus driver circuit according to the second embodiment.
Figure 11:
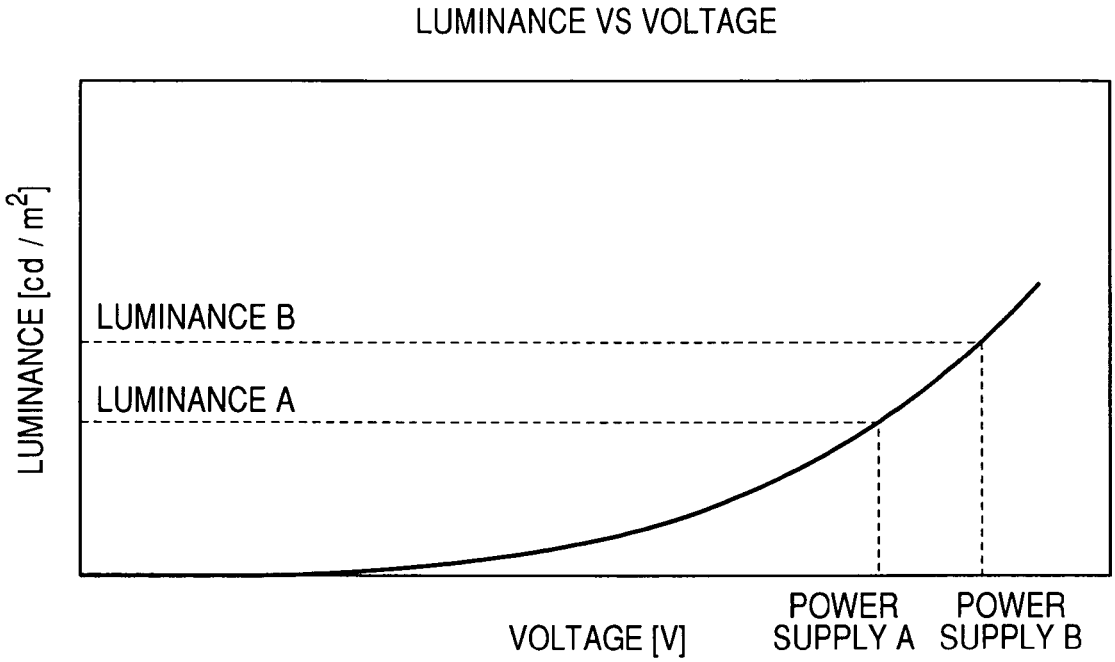
FIG. 11 is a diagram showing a voltage-to-current characteristic of an OLED element.
Figure 12:
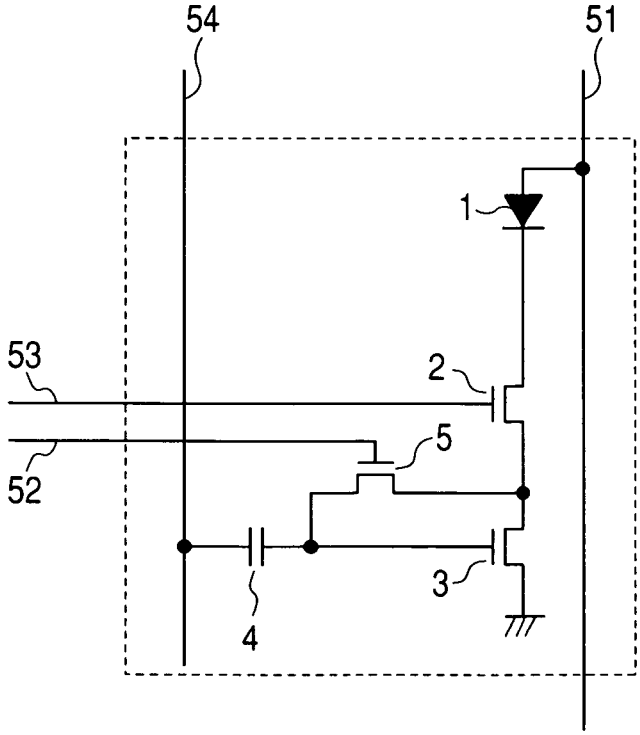
FIG. 12 is a diagram showing a pixel unit driver circuit according to a first conventional example.
Figure 13:
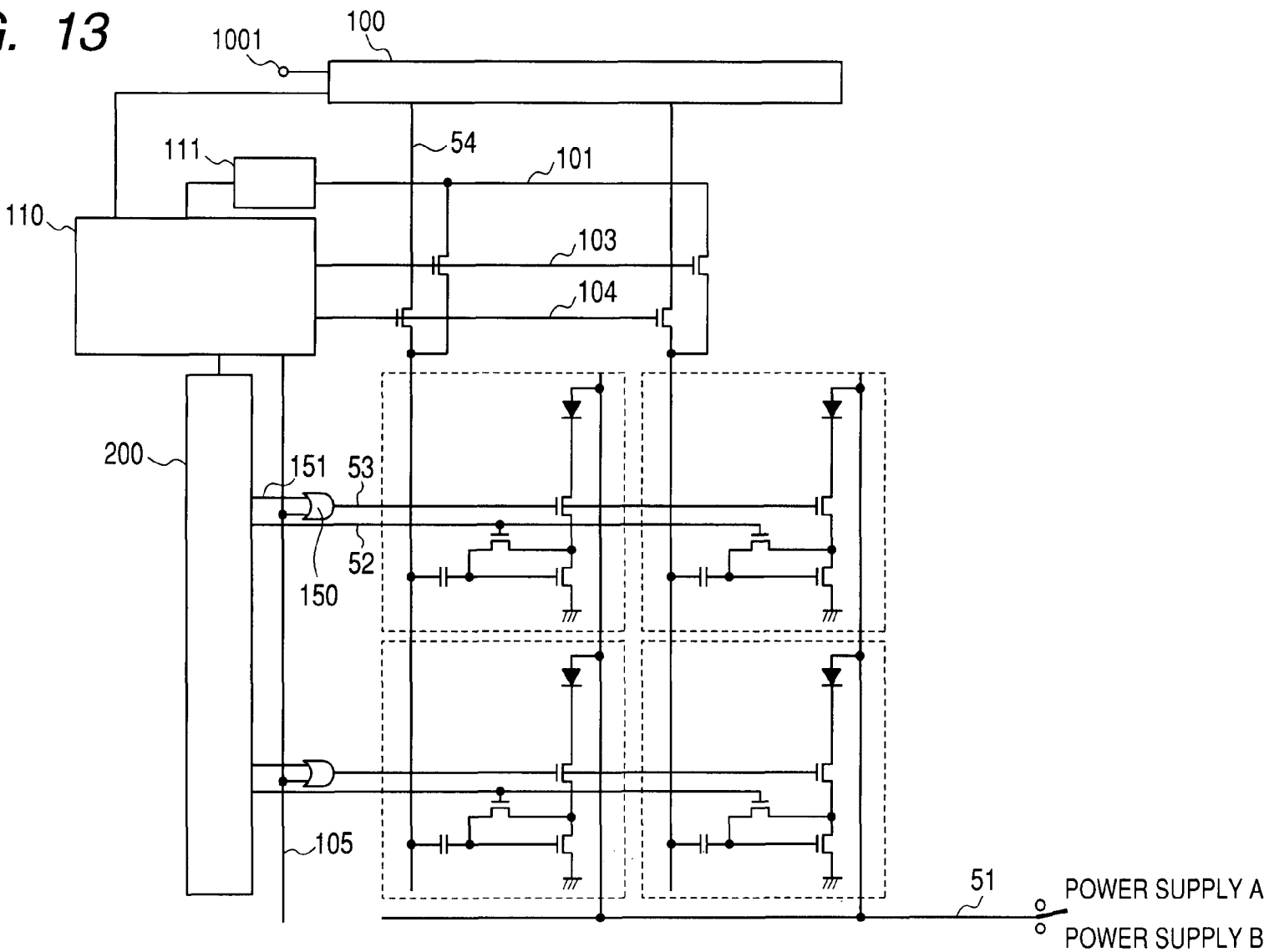
FIG. 13 is a diagram showing a display apparatus driver circuit according to the first conventional example.
Figure 14:
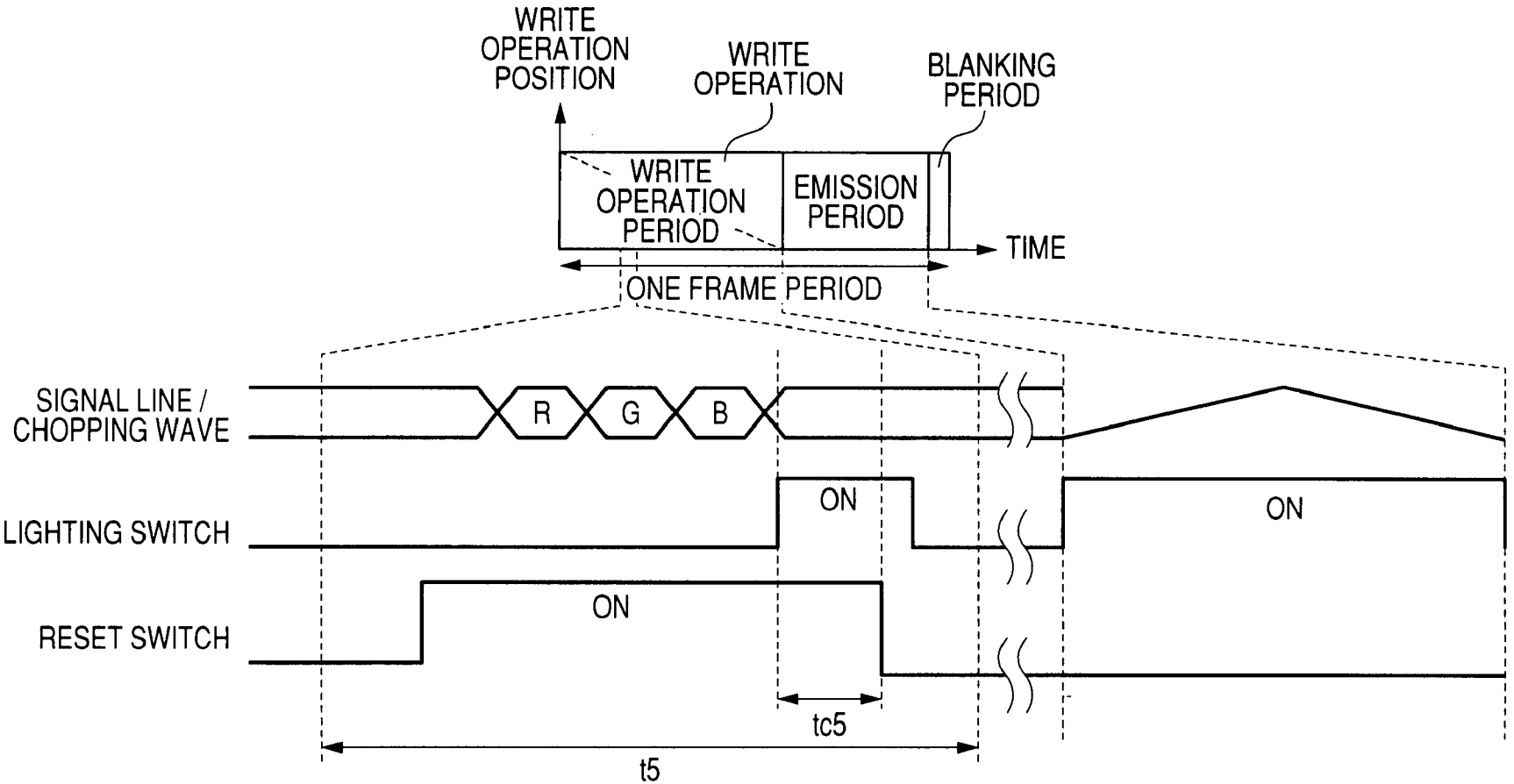
FIG. 14 is a timing chart of the first conventional art.
Figure 15:
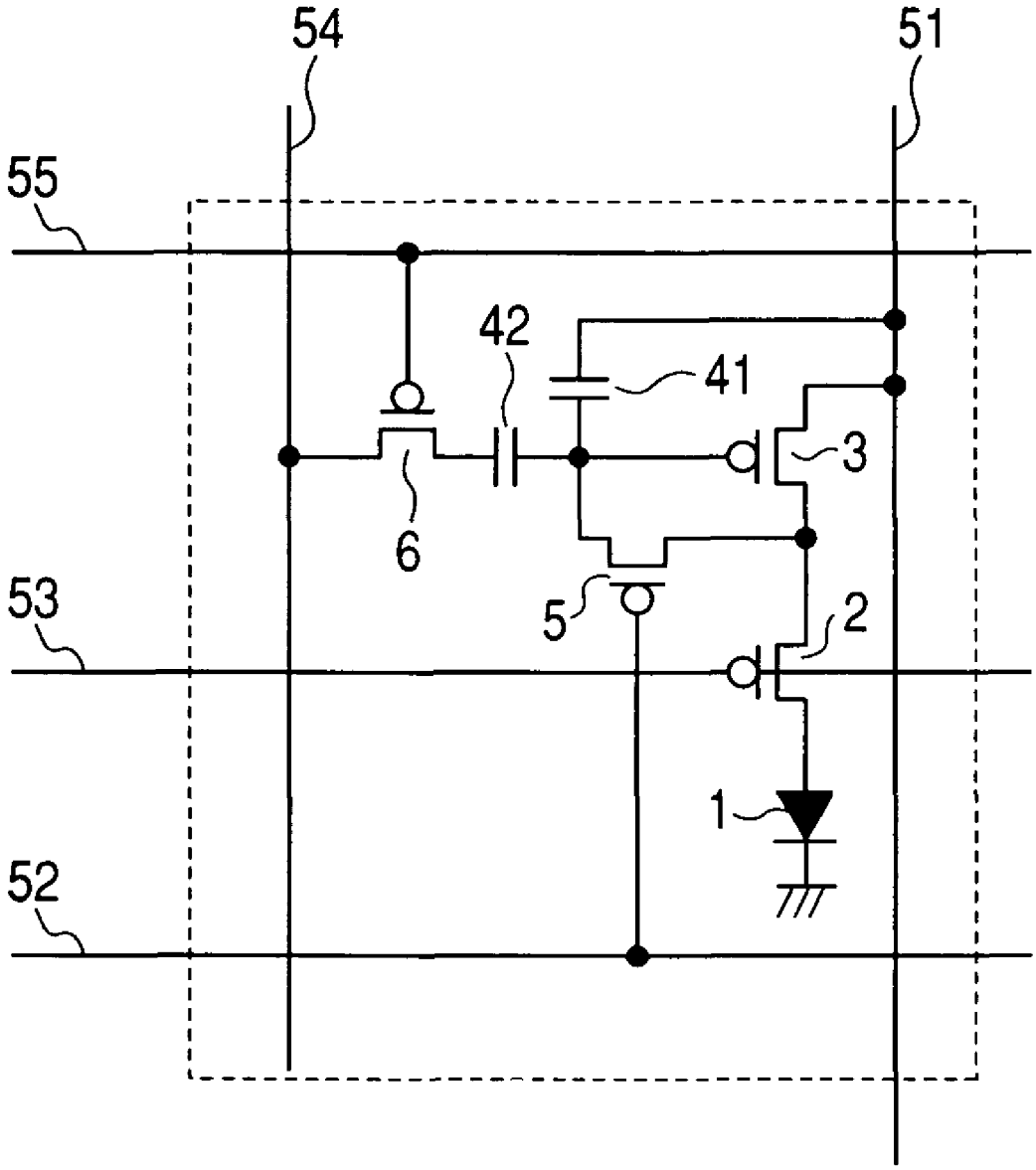
FIG. 15 is a diagram showing a pixel unit driver circuit according to a second conventional example.
Figure 16:
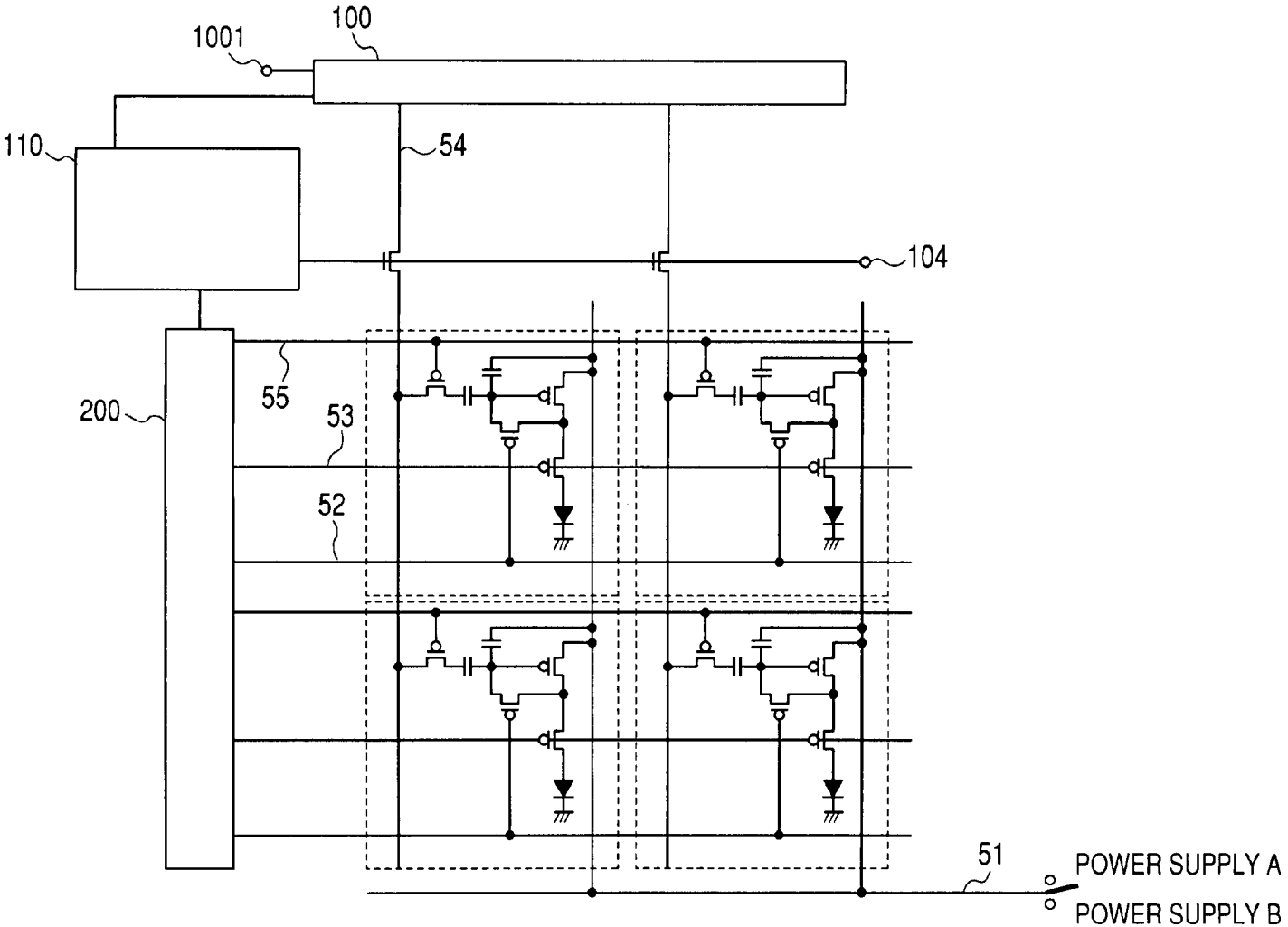
FIG. 16 is a diagram showing a display apparatus driver circuit according to the second conventional example.
Figure 17:
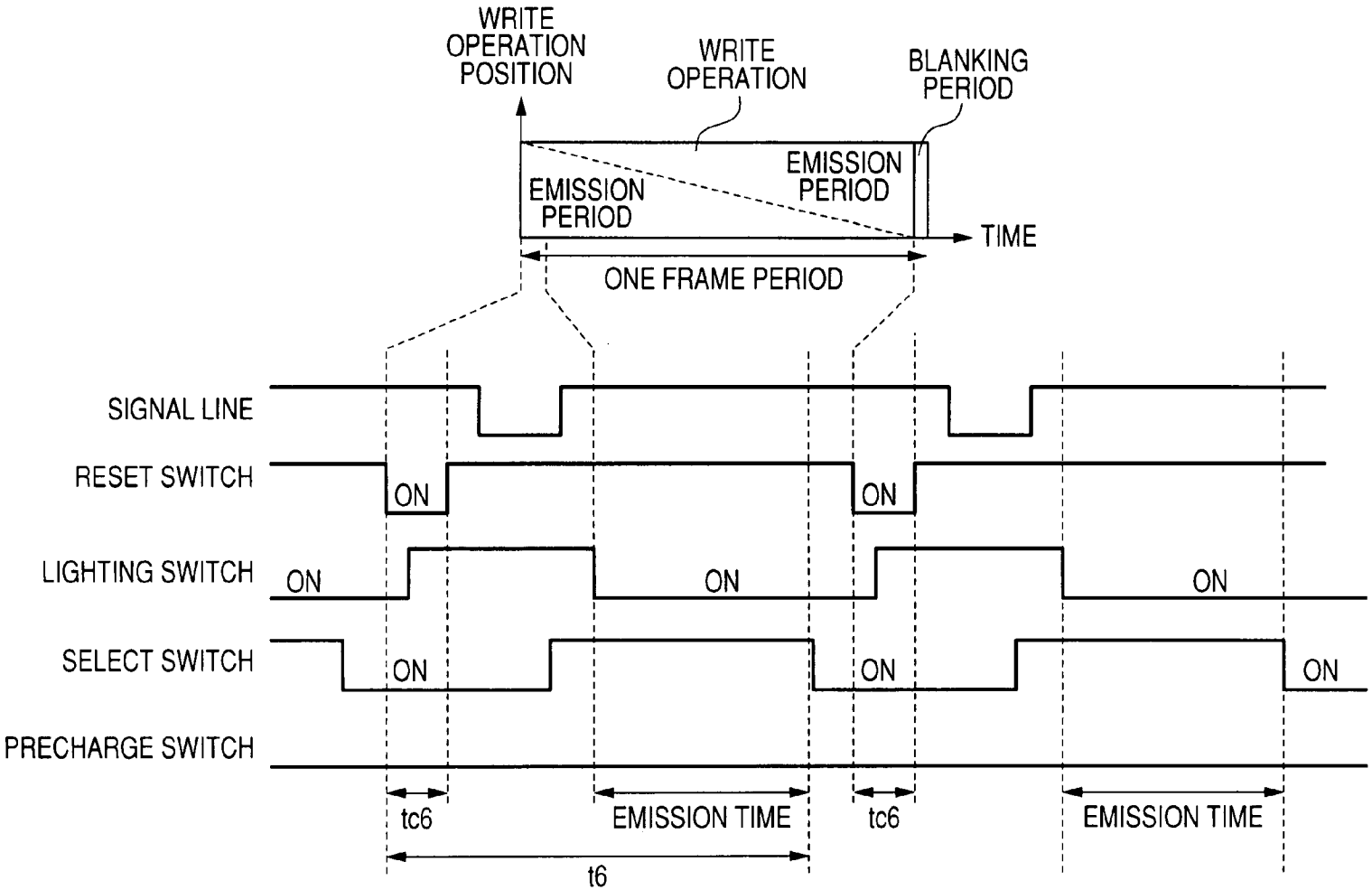
FIG. 17 is a timing chart of the second conventional art.
Figure 18:
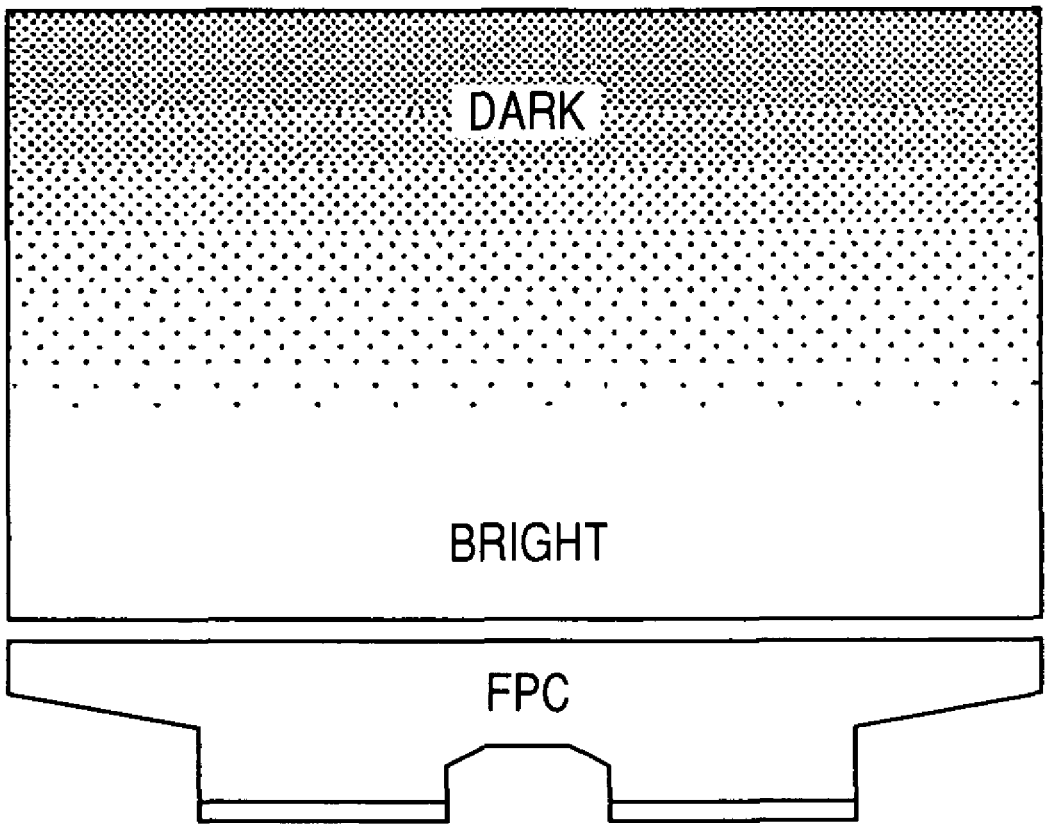
FIG. 18 is a diagram showing an example in which an uneven luminance occurs in a screen.

As described above, according to the second embodiment, it is possible to ensure the blanking period during one frame while the accurate gradation display can be conducted in both of the standard mode and the high luminance mode. FIG. 10 shows a circuit in the case of detecting the current-to-voltage characteristic of the OLED element 1 during the blanking period. The detection system 120 is identical with that in the first embodiment. However, a direction of the current source 112 allows the current to flow toward the OLED element 1.

Referring to FIG. 10, the lighting TFT switch 2 turns off during the blanking period. At the same time, the precharge TFT switch 7 turns on, and a measurement current is allowed to flow from the current source 112 of the detection system 120 toward the OLED element 1 through the precharge TFT switch 7. The anode potential of the OLED element 1 at that time is measured to enable the current-to-voltage characteristic of the OLED element 1 to be measured. The measurement result is stored in the memory 113, and fed back to the display data. The detection operation can be conducted in both of the standard mode and the high luminance mode.

As described above, according to this embodiment, the gradation display is precisely conducted to enable the blanking period to be ensured in both of the standard mode and the high luminance mode. Also, the characteristic change of the OLED element 1 is measured by using the precharge TFT switch 7 used in the precharge operation to enable the characteristic change to be fed back to the display data. In addition, when the write period of the data signal can be reduced by the precharge before the reset operation, it is possible to increase the blanking period during one frame. With the above operation, it can take longer time to measure the voltage-to-current characteristic of the OLED element 1 during the blanking period. When it can take longer time to measure the voltage-to-current characteristic, the current of the current source 112 used for measurement is reduced, thereby making it possible to reduce an electric power used in the detection system 120.

Figure 19B:
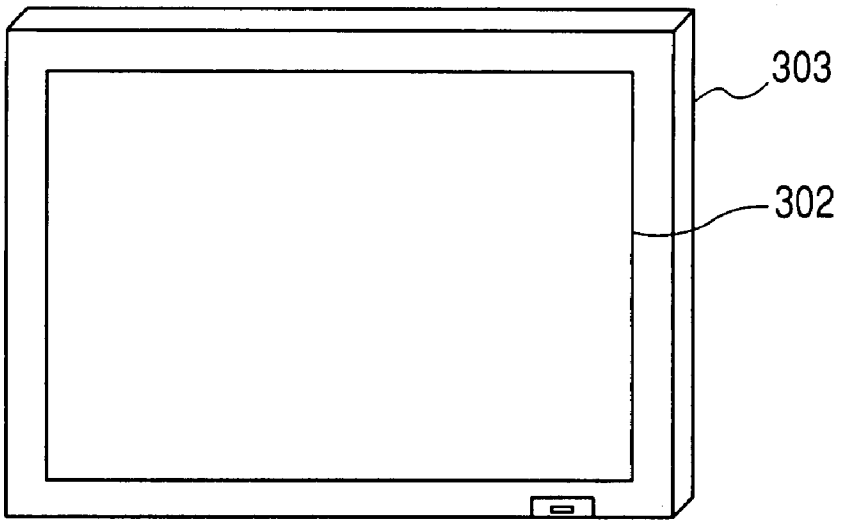
FIGS. 19A and 19B are diagrams showing an example of a product according to the present invention.
Figure 19A:
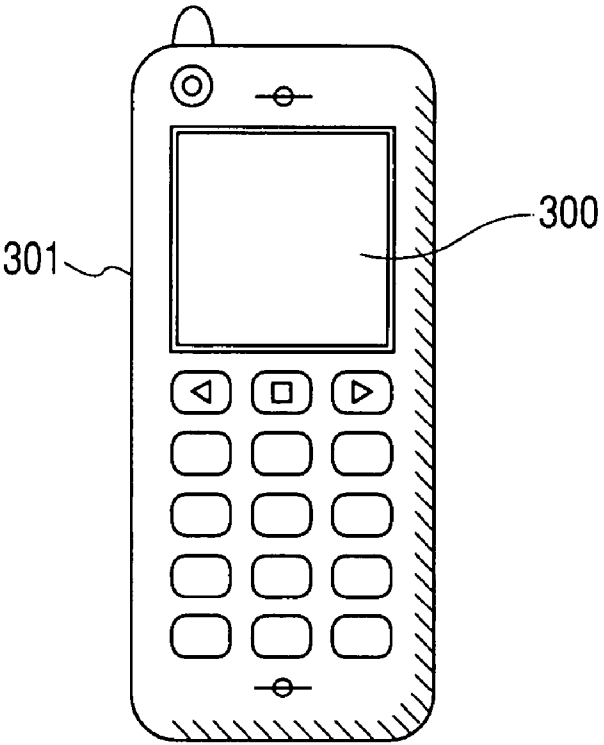

In FIG. 19A, an image display apparatus 300 according to the present invention is used for the image display unit of the mobile electronic device 301, thereby making it possible to realize the high-quality display apparatus that is capable of conducting the mode changeover according to the display luminance at the time of the maximum gradation.

In FIG. 19B, an image display apparatus 302 according to the present invention is used for the image display unit of a television 303, thereby making it possible to realize the high-quality display apparatus that is capable of conducting the mode changeover according to the display luminance at the time of the maximum gradation.

Figure 20B:
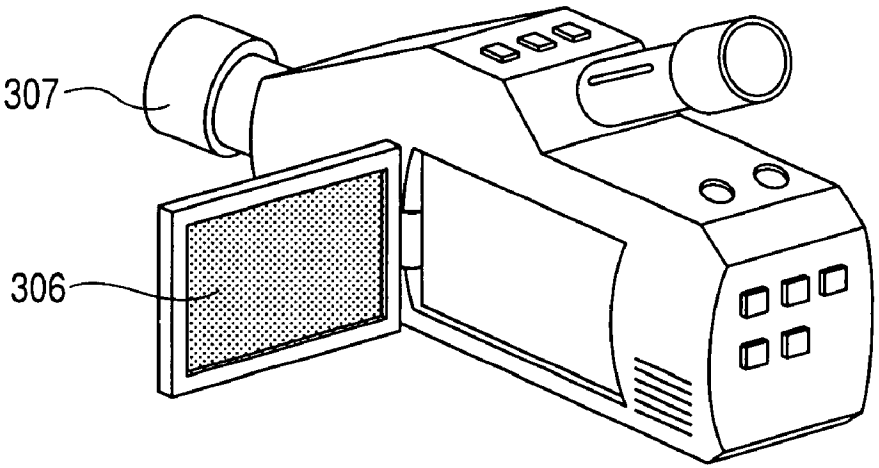
FIGS. 20A and 20B are diagrams showing another example of a product according to the present invention.
Figure 20A:
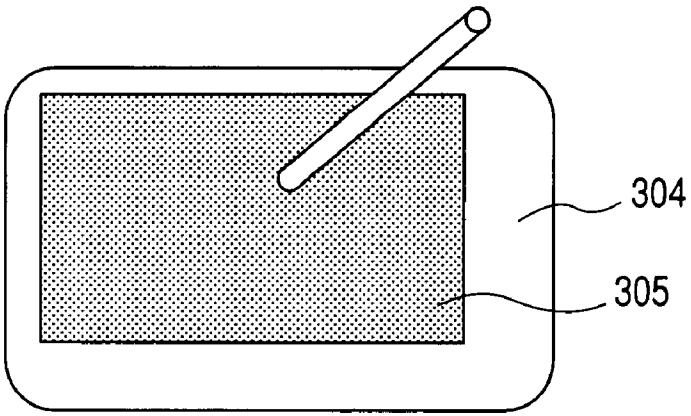

In FIG. 20A, an image display apparatus 304 according to the present invention is used for the image display unit of a digital mobile terminal PDA 305, thereby making it possible to realize the high-quality display apparatus that is capable of conducting the mode changeover according to the display luminance at the time of the maximum gradation.

In FIG. 20B, an image display apparatus 306 according to the present invention is used for the image display unit of a view finder 307 of a video camera CAM, thereby making it possible to realize the high-quality display apparatus that is capable of conducting the mode changeover according to the display luminance at the time of the maximum gradation.

What is claimed is:

1. An image display apparatus, comprising:

a display unit having a plurality of pixels with light emitting elements formed in a matrix;

a display signal driving circuit that drives a signal line and a display signal voltage for inputting a display signal voltage to a pixel region;

a control line for inputting a control signal to the pixel region;

a control signal driving circuit for driving the control signal; and a field effect transistor for driving the light emitting elements on the basis of a display signal that is inputted to the pixels through the signal line, wherein the control signal driving circuit changes the drive control signal according to a voltage or a signal related to a plurality of luminance modes, and wherein the field effect transistor has a source electrode, a gate electrode and a drain electrode, the source electrode being connected to a supply potential, the gate electrode being connected with a first switch for connecting the gate electrode and the drain electrode to each other and a capacitor, and the drain electrode being connected with a third switch for controlling the supply of a current on the basis of the image data signal to the light emitting element, wherein the light emitting element has an anode and a cathode, and the anode is connected with the third switch and a second switch for applying a given voltage from the external, and wherein, in any of the plurality of luminance modes, a precharge operation is conducted by turning on the second switch during a period in which the first and the third switches turn on at the same time.

2. The image display apparatus according to claim 1, wherein the light emitting element comprises an organic light emitting diode (OLED) element.

3. The image display apparatus according to claim 1, wherein the field effect transistor is disposed on a transparent substrate with the use of a polysilicon TFT (thin film transistor).

4. The image display apparatus according to claim 1, wherein the pixel has a switch that is connected with a detector circuit that can measure a current-to-voltage characteristic of the light emitting element.

5. The image display apparatus according to claim 4, wherein the luminance of a maximum gradation in the second luminance mode is higher than the luminance of the maximum gradation in the first luminance mode, and the display apparatus can display a first luminance mode and a second luminance mode that is higher in the luminance than the first luminance mode, and applies a given voltage from the external to a gate electrode of the field effect transistor by using the switch in an initial stage where an image signal is written in the pixel at the time of the first luminance mode.

6. The image display apparatus according to claim 4, wherein the light emitting element comprises an organic light emitting diode (OLED) element.

7. The image display apparatus according to claim 4, wherein the field effect transistor and the switch are disposed on a transparent substrate with the use of a polysilicon TFT (thin film transistor).

8. An image display apparatus, comprising:

a display unit that is formed of a plurality of pixels with light emitting elements;

a signal line that inputs a display signal to a pixel region;

a display signal driving circuit that drives a display signal voltage;

a control line for inputting a control signal to the pixel region;

a control signal driving circuit for driving the control signal; and a field effect transistor for driving the light emitting element on the basis of an image data signal that is inputted to the pixel through the signal line, wherein the field effect transistor has a source electrode applied with a supply potential, a gate electrode connected with a first switch for connecting the gate and drain of the field effect transistor to each other and a capacitor, and a drain electrode connected with a third switch for controlling the supply of a current on the basis of the image data signal to the light emitting element, wherein the light emitting element has an anode and a cathode, and the anode is connected with the third switch and a second switch for applying a given voltage from the external, and wherein the control signal driving circuit changes the drive control signal according to a voltage or a signal related to a plurality of light emitting luminance, and wherein, in any of the plurality of luminance modes, a precharge operation is conducted by turning on the second switch during a period in which the first and the third switches turn on at the same time.

9. The image display apparatus according to claim 8, wherein the second switch controls a connection to a detector circuit that can measure the current-to-voltage characteristic of the light emitting element.

10. The image display apparatus according to claim 8, wherein the display apparatus can display a first luminance mode and a second luminance mode that is higher in the luminance than the first luminance mode, and applies a given voltage from the external to a gate electrode of the field effect transistor by using the second switch in an initial stage where an image signal is written in the pixel at the time of the first luminance mode.

11. The image display apparatus according to claim 8, wherein the light emitting element comprises an organic light emitting diode (OLED) element.

12. The image display apparatus according to claim 8, wherein the field effect transistor and the first to third switches are disposed on a transparent substrate with the use of a polysilicon TFT (thin film transistor).

13. An image display apparatus, comprising:

a display unit that is formed of a plurality of pixels with light emitting elements;

a signal line that inputs a display signal to a pixel region;

a display signal driving circuit that drives a display signal voltage;

a control line for inputting a control signal to the pixel region;

a control signal driving circuit for driving the control signal; and a field effect transistor for driving the light emitting element on the basis of an image data signal that is inputted to the pixel through the signal line, wherein the field effect transistor has a source electrode applied with a reference potential, a gate electrode connected with a first switch for connecting the gate and drain of the field effect transistor to each other and a capacitor, and a drain electrode connected with a third switch for controlling the supply of a current on the basis of the image data signal to the light emitting element, wherein the light emitting element has an anode and a cathode, and the anode is connected with the third switch and a second switch for applying a given voltage from the external, and wherein the control signal driving circuit changes the drive control signal according to a voltage or a signal related to a plurality of light emitting luminance, and wherein, in any of the plurality of luminance modes, a precharge operation is conducted by turning on the second switch during a period in which the first and the third switches turn on at the same time.

14. The image display apparatus according to claim 13, wherein the second switch controls a connection to a detector circuit that can measure the current-to-voltage characteristic of the light emitting element.

15. The image display apparatus according to claim 13, wherein the display apparatus can display a first luminance mode and a second luminance mode that is higher in the luminance than the first luminance mode, and applies a given voltage from the external to a gate electrode of the field effect transistor by using the second switch in an initial stage where an image signal is written in the pixel at the time of the first luminance mode.

16. The image display apparatus according to claim 13, wherein the light emitting element comprises an organic light emitting diode (OLED) element.

17. The image display apparatus according to claim 13, wherein the field effect transistor and the first to third switches are disposed on a transparent substrate with the use of a polysilicon TFT (thin film transistor).

* * * * *